US005228930A

United States Patent [19]

Nakayama et al.

[11] Patent Number: 5,228,930

[45] Date of Patent: Jul. 20, 1993

[54] RARE EARTH PERMANENT MAGNET POWER, METHOD FOR PRODUCING SAME AND BONDED MAGNET

[75] Inventors: Ryoji Nakayama; Takuo Takeshita; Tamotsu Ogawa, all of Omiya, Japan

[73] Assignee: Mitsubishi Materials Corporation, Tokyo, Japan

[21] Appl. No.: 560,594

[22] Filed: Jul. 31, 1990

[30] Foreign Application Priority Data

| | | | |
|---|---|---|---|
| Jul. 31, 1989 | [JP] | Japan | 1-198836 |
| Jul. 31, 1989 | [JP] | Japan | 1-198837 |
| Oct. 31, 1989 | [JP] | Japan | 1-284293 |
| May 11, 1990 | [JP] | Japan | 2-122651 |
| Jul. 12, 1990 | [JP] | Japan | 2-184779 |
| Jul. 13, 1990 | [JP] | Japan | 2-185951 |

[51] Int. Cl.[5] ..... H01F 1/053

[52] U.S. Cl. ..... 148/302; 420/83; 420/121; 252/62.54; 75/244

[58] Field of Search ..... 148/302; 420/83, 121; 252/62.54; 75/244

[56] References Cited

U.S. PATENT DOCUMENTS

| | | | |
|---|---|---|---|
| 4,935,075 | 6/1990 | Mizoguchi et al. | 148/302 |
| 4,981,532 | 1/1991 | Takeshita et al. | 148/302 |

FOREIGN PATENT DOCUMENTS

| | | |
|---|---|---|
| 0274034 | 7/1988 | European Pat. Off. . |
| 0304054 | 2/1989 | European Pat. Off. . |
| 2303697 | 12/1973 | Fed. Rep. of Germany . |
| 2387500 | 11/1978 | France . |
| 1438091 | 3/1976 | United Kingdom . |
| 1554384 | 10/1979 | United Kingdom . |

OTHER PUBLICATIONS

Panchanathan, et al., Properties of Rapidly Solidified Nd-Fe-Ca-Co-B Alloys, IEEE Transactions on Magnetics, vol. 25, No. 5, Sep. 1989, pp. 4111-4113.

*Primary Examiner*—John P. Sheehan

*Attorney, Agent, or Firm*—Scully, Scott, Murphy & Presser

[57] ABSTRACT

There is disclosed a R-Fe-B or R-Fe-Co-B alloy permanent magnet powder which may contain Ga, Zr or Hf, or may further contain Al, Si or V. Each individual particle of the powder includes a structure of recrystallized grains containing a $R_2Fe_{14}B$ or $R_2(Fe,Co)_{14}B$ intermetallic compound phase. The intermetallic compound phase has recrystallized grains of a tetragonal crystal structure having an average crystal grain size of 0.05 to 20 μm. At least 50% by volume of the recrystallized grains of the aggregated structure are formed so that a ratio of the greatest dimension to the smallest dimension is less than 2 for each recrystallized grain. In order to manufacture the magnet powder, regenerative material and alloy material are prepared and their temperature is elevated in a hydrogen atmosphere. Then, the alloy material and the regenerative material are held in the same atmosphere at a temperature of 750° C. to 950° C., and then held in a vacuum at 750° C. to 950° C., and cooled and crushed. A bonded magnet produced using the above magnet powder is also disclosed.

14 Claims, 3 Drawing Sheets

RARE EARTH PERMANENT MAGNET POWER, METHOD FOR PRODUCING SAME AND BONDED MAGNET

BACKGROUND OF THE INVENTION

1. Field of the Invention

The present invention relates to a rare earth permanent magnet powder which exhibits superior magnetic properties, particularly anisotropy and corrosion resistance, a method for producing the same, and bonded magnets produced using the above rare earth permanent magnet powder.

2. Prior Art

The rare earth-iron-boron alloy permanent magnet powder, comprising iron (Fe), boron (B) and a rare earth element (which is now defined to include yttrium (Y) and will be hereinafter represented by R when appropriate), has drawn general attention as a permanent magnet material which exhibits superior magnetic properties, and it has since been in the development stage as a magnet powder for bonded magnets. Although a bonded magnet is inferior in magnetic property when compared to sintered magnets of the same magnet powder, its field of application has grown and continues to grow rapidly in recent years because of its superior physical strength and higher flexibility in shape. These bonded magnets are composed by binding magnet powder with organic binders and/or metallic binders, or the like; and magnetic properties of these bonded magnets depend on the magnetic properties of such magnet powders.

Japanese Patent Application A-Publication No. 1-132106 describes one prior art R-Fe-B permanent magnet powder used to manufacture a bonded magnet. The R-Fe-B permanent magnet powder is manufactured by preparing a R-Fe-B alloy having a ferromagnetic $R_2Fe_{14}B$ intermettalic compound phase as its principal phase, subsequently heat-treating the alloy in a prescribed temperature range in a hydrogen atmosphere to cause phase transformation in $RH_x$ phase, $Fe_2B$ phase and the remaining Fe phase, and subsequently subjecting the alloy to dehydrogenation to reproduce the $R_2Fe_{14}B$ phase. The resulting magnet powder has an aggregated structure of recrystallized grains of $R_2Fe_{14}B$ phase having a minuscule average grain size of 0.05 μm to 3 μm.

Japanese Patent Application A-Publication No. 1-132106 further describes a R-Fe-Co-B permanent magnet powder, i.e., a R-Fe-B magnet powder in which a part of Fe is substituted by cobalt (Co). This magnet powder has also an aggregated structure of recrystallized grains of $R_2(Fe,Co)_{14}B$ phase having an average grain size of 0.05 μm to 3 μm.

The aforesaid prior art magnet powders exhibit magnetic anisotropy, but anisotropy is often reduced due to small fluctuations in alloy composition or manufacturing conditions, and hence it is difficult to obtain stable and superior magnetic anisotropy.

Known methods for imparting magnetic anisotropy to a magnet powder involve subjecting the permanent magnet powder to hot plastic working, such as hot rolling and hot extrusion, to thereby form the crystal grains of the magnet powder into a flat shape. In such a hot plastic working, however, the degree of working varies depending upon the locations, and hence a magnet powder having a stable and uniform magnetic anisotropy cannot be obtained. In addition, the manufacturing process is intricate, and hence the manufacturing costs are unduly high.

Furthermore, the flat recrystallized grains formed by means of hot plastic working are more susceptible to corrosion than the magnet powder comprising recrystallized grains which are not hot-worked. As a result, when the magnet powder is kept in a high-temperature and high-humidity atmosphere, such as in a factory, for a prolonged period of time, the surface of the magnet powder is corroded, and its magnetic property is unduly reduced.

SUMMARY OF THE INVENTION

It is therefore an object of the present invention to provide a rare earth permanent magnet powder which exhibits superior magnetic properties and high resistance to corrosion.

Another object of the invention is to provide an improved method which can produce the above permanent magnet powder without conducting any hot plastic working such as hot rolling.

Yet another object of the invention is to provide a bonded magnet produced using the above permanent magnet powder.

According to a first aspect of the invention, there is provided a rare earth permanent magnet powder comprising particles each containing 10 to 20 atomic percent of R, 3 to 20 atomic percent of B, 0.001 to 5.0 atomic percent of at least one element selected from the group consisting of Ga, Zr and Hf, balance Fe, or Fe and Co, and unavoidable impurities, the individual particle comprising an aggregated structure of recrystallized grains containing a $R_2Fe_{14}B$ intermetallic compound phase as a principal phase, the intermetallic compound phase consisting of recrystallized grains of a tetragonal crystal structure having an average crystal grain size of 0.05 to 20 μm, wherein at least 50% by volume of the recrystallized grains of the aggregated structure includes recrystallized grains formed so that a ratio of the greatest dimension to the smallest dimension is less than 2 for each recrystallized grain. In the foregoing, the composition of the alloy may be modified to further improve the magnetic properties and high resistance to corrosion of the magnet powder.

According to a second aspect of the invention, there is provided a method for producing a rare earth permanent magnet powder comprising the steps of:

(a) preparing a rare earth alloy material and a regenerative material;

(b) subsequently elevating the temperature of the alloy material and the regenerative material in a hydrogen atmosphere and holding the same in the hydrogen atmosphere at a temperature of 750° C. to 950° C.;

(c) subsequently holding the alloy and the regenerative material at a temperature of 750° C. to 950° C. in a vacuum; and (d) subsequently cooling and crushing the alloy.

According to a third aspect of the invention, there is provided a bonded magnet produced using the permanent magnet powder as described above.

DESCRIPTION OF THE INVENTION

Figure 1:
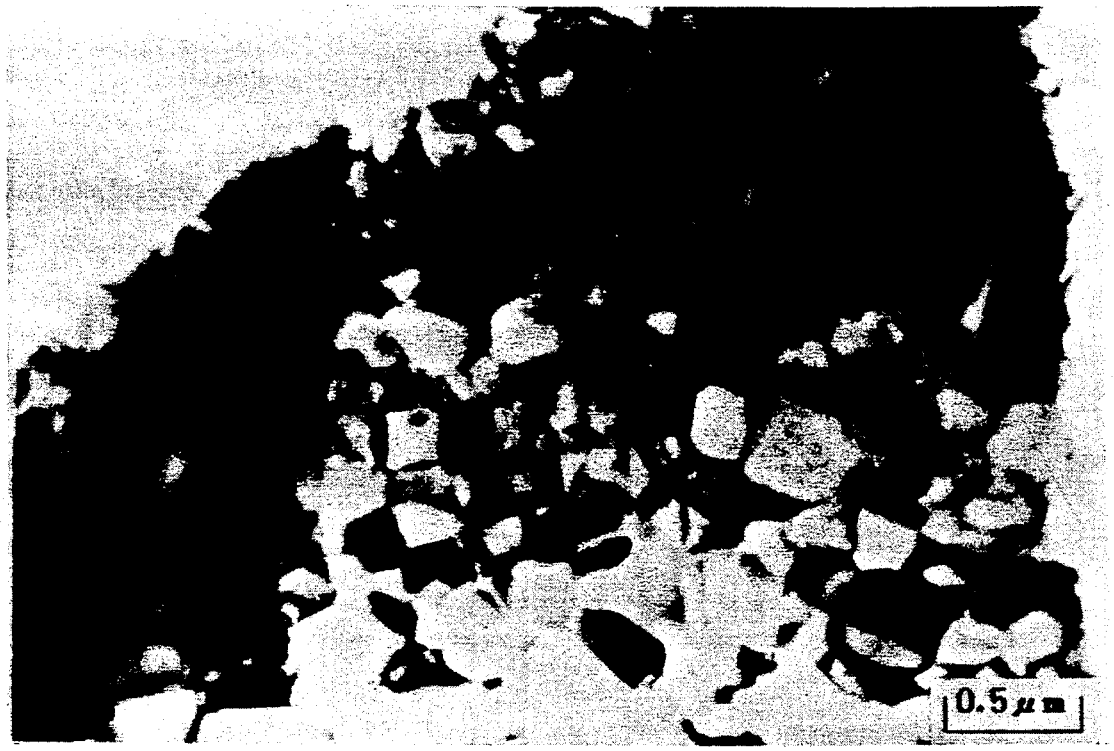
FIG. 1 is a photomicrograph of a microstructure of a R-Fe-B permanent magnet powder in accordance with the present invention.

The inventors have made an extensive study in regard to the improvement of the prior art magnet powders, and have come to the understanding that among permanent magnet powders comprising a recrystallized grain structure of $R_2Fe_{14}B$ principal phase, the magnet powder containing 0.001 to 5.0 atomic percent of at least one of gallium (Ga), zirconium (Zr) and hafnium (Hf), can be produced so as to have superior magnetic anisotropy without subjecting the powder to hot plastic working. In addition, the R-Fe-B permanent magnet powder comprising a structure of recrystallized grains for which (greatest dimension b)/(smallest dimension a)<2 for each recrystallized grain indicates substantially improved corrosion resistance.

The permanent magnet powder in accordance with the present invention is produced based on the aforesaid facts, and is characterized in that each particle contains 10 to 20 atomic percent of R; 3 to 20 atomic percent of B; 0.001 to 5.0 atomic percent of at least one of Ga, Zr and Hf or further added 0.01 to 2.0 atomic percent of at least one of Al, V and Si; balance Fe; and unavoidable impurities; that an individual particle thereof comprises a structure of recrystallized grains containing a $R_2Fe_{14}B$ intermetallic compound phase as a principal phase, the intermetallic compound phase consisting of recrystallized grains of a tetragonal crystal structure having an average crystal grain size of 0.05 to 20 μm, and that the ratio of the greatest dimension b to the smallest dimension a is less than 2 for each recrystallized grain.

The permanent magnet powder as described above is produced as follows:

Prescribed materials are melted and cast into a R-Fe-B alloy material of a predetermined composition containing Ga, Zr or Hf, or further added Al, V and Si and the alloy material thus produced is heated in a hydrogen atmosphere and further subjected to heat-treatment at 500° C. to 1000° C. either in a hydrogen gas atmosphere or in a mixed gas atmosphere of hydrogen and inert gases. Thereafter, the alloy material is subjected to dehydrogenation at 500° C. to 1000° C. until the atmosphere reaches a vacuum having hydrogen gas pressure of no greater than 1 torr, or an inert gas atmosphere wherein the partial pressure of hydrogen gas is no greater than 1 torr. Then, the alloy is cooled, and the permanent magnet powder is thus produced.

In addition, if the R-Fe-B alloy is homogenized at a temperature of 600° C. to 1200° C., or if the dehydrogenated alloy is heat-treated at a temperature of 300° C. to 1000° C., the magnetic anisotropy and corrosion resistance are further improved.

The R-Fe-B permanent magnet powder thus produced comprises an aggregate structure of recrystallized grains of the $R_2Fe_{14}B$ phase which contains neither impurities nor strain in the grains or at the grain boundaries. The recrystallized grain structure of each particle is formed so as to have an average grain size ranging from 0.05 μm to 20 μm. If it is less than 0.05 μm, it is difficult to magnetize the powder. On the other hand, if it is greater than 20 μm, the coercivity and squareness of the magnetization curve will be reduced, resulting in inferior magnetic properties. It is however more preferable that the average grain size ranges from 0.05 to 3 μm, which is close to about 0.3 μm, wherein the recrystallized grains become particles of a single magnetic domain. In addition, each recrystallized grain should preferably have such a shape that the ratio of the greatest dimension b to the smallest dimension a is less than 2, and the amount of the recrystallized grains of such a shape should be at least 50% by volume of the total amount of recrystallized grains. Due to the recrystallized grains of the above shape, the coercivity and corrosion resistance of the R-Fe-B permanent magnet powder can be improved. When compared with the magnet powder produced by means of hot plastic working, the resulting magnet powder is superior in corrosion resistance and exhibits stable and excellent magnetic properties. In addition, the yield in manufacture is improved.

Moreover, the recrystallized grain structure of the R-Fe-B magnet powder thus obtained is an aggregated one that consists essentially of recrystallized grains of $R_2Fe_{14}B$ phase and has almost no R-rich phase on the grain boundary. Therefore, the value of the magnetization of the magnet powder can be further enhanced, and the corrosion which may develop through the R-rich phase on the grain boundary is prevented. In addition, since there exist no strains due to hot plastic working, stress corrosion can be avoided. Thus, the corrosion resistance of the magnet powder is improved.

Furthermore, when bonded magnets are produced using the above permanent magnet powder, the resulting magnets also exhibit superior magnetic anisotropy and corrosion resistance.

The reasons for the limitation of the numerical range of the alloy composition are as follows:

(a) with respect to R

R represents at least one element selected from the group consisting of neodymium (Nd), praseodymium (Pr), terbium (Tb), dysprosium (Dy), lanthanum (La), cerium (Ce), holmium (Ho), erbium (Er), europium (Eu), samarium (Sm), gadolinium (Gd), thulium (Tm), ytterbium (Yb), lutetium (Lu) and Y. Nd is mainly used, and other rare earth elements are added to it. Among those elements, Tb, Dy and Pr enhance coercivity (iHc). If the R content is less than 10 atomic percent, the coercivity of the resulting permanent magnet powder becomes insufficient. On the other hand, if the R content exceeds 20 atomic percent, sufficient coercivity cannot be obtained. Therefore, the R content should be determined so as to be within the range of 10 atomic percent and 20 atomic percent.

(b) with respect to B

If the B content is less than 3 atomic percent or greater than 20 atomic percent, the coercivity of the permanent magnet powder is reduced, resulting in inferior magnetic properties. Therefore, the B content is determined to the range of between 3 to 20 atomic percent.

(c) with respect to Ga, Zr or Hf

Ga, Zr or Hf contained in the permanent magnet powder enhances coercivities and imparts superior magnetic anisotropy and corrosion resistance. If the content is less than 0.001 atomic percent, desired effects cannot be obtained. On the other hand, if the content exceeds 5.0 atomic percent, the magnetic properties are deteriorated. Therefore, the content of one or more of these elements is determined so as to range from 0.001 atomic percent to 5.0 atomic percent.

In the foregoing, 0.01 to 2.0 atomic percent of at least one of aluminum (Al), vanadium (V) and silicon (Si) may further be added in the R-Fe-B permanent magnet powder as necessary. Such an element enhances maximum energy product when its content is no less than 0.01 atomic percent. However, even if it is added in an amount of greater than 2.0 atomic percent, the magnetic properties cannot be improved, and hence the content should range from 0.01 atomic percent to 2.0 atomic percent.

The above reasons will be also applicable to the bonded magnets produced of the same R-Fe-B permanent magnet powder.

Furthermore, a part of Fe in the aforesaid R-Fe-B permanent magnet powders of various kinds may be substituted by Co. This modified permanent magnet powder is characterized in that it contains 10 to 20 atomic percent of R, 0.1 to 50 atomic percent of Co, 3 to 20 atomic percent of B, 0.001 to 5.0 atomic percent of at least one of Ga, Zr and Hf, balance Fe and unavoidable impurities, and that the individual particle thereof comprises a structure of recrystallized grains containing a $R_2(Fe,Co)_{14}B$ intermetallic compound phase as a principal phase, the intermetallic compound phase consisting of recrystallized grains of a tetragonal crystal structure having an average crystal grain size of 0.05 to 20 μm, the ratio of the greatest dimension b to the smallest dimension a being less than 2 for each recrystallized grain.

Co existing in the permanent magnet powder enhances coercivities and magnetic temperature characteristics, e.g., Curie point, and further improves the corrosion resistance. However, if the Co content is less than 0.1 atomic percent, desired effects cannot be achieved. On the other hand, if the Co content exceeds 50 atomic percent, the magnetic properties are deteriorated instead. Therefore, the Co content is determined so as to range between 0.1 and 50 atomic percent. However, it is more preferable that the Co content ranges from 0.1 to 20 atomic percent since the coercivities reach the maximum within this range.

In the R-Fe-B alloy and R-Fe-Co-B alloy magnet powders as described above, Al, V or Si may be further added as is the case with the previous R-Fe-B alloy magnet powder.

The processes for manufacturing the above permanent magnet powders will next be described.

After an extensive study, the inventors have clarified the causes of the variations in the manufacturing process. More specifically, in a hydrogen atmosphere at 750° C. to 950° C., the $R_2Fe_{14}B$ phase of the R-Fe-B alloy ingot or powder is transformed into three phases as follows:

$$R_2Fe_{14}B \rightarrow RH_2 + Fe + Fe_2B \quad (1).$$

Thereafter, in the dehydrogenation process, the phase is again transformed into an aggregated structure of recrystallized grains of $R_2Fe_{14}B$ phase as follows:

$$RH_2 + Fe + Fe_2B \rightarrow R_2Fe_{14}B \quad (2).$$

The reaction (2) is endothermic, and the temperature fluctuates while being lowered during the reaction. In addition, the temperature also varies depending upon location in the vessel into which the R-Fe-B alloy ingot or powder is filled. Due to these temperature variations, the magnetic anisotropy of the recrystalized grain structure of the resulted R-Fe-B permanent magnet powder is variable.

The inventors have determined that in order to effect the above reactions uniformly without causing any variability, the temperature elevation step, from room temperature to the temperature of 750° C. to 950° C., should be carried out in a hydrogen atmosphere, and have also found that the use of regenerative material is very effective. Namely, when the R-Fe-B alloy ingot or powder is heated to a prescribed temperature together with a regenerative material in a hydrogen atmosphere and is then kept in a vacuum at the same temperature, the temperature variation during the endothermic reaction (2) is prevented by the heat conserving effect of the regenerative material, so that the temperature is uniformly maintained at a prescribed high temperature. Therefore, the lowering and fluctuation of the magnetic anisotropy for the resulting R-Fe-B permanent magnet powder can be eliminated.

The inventors have also found that when a R-Fe-(Co)-B alloy ingot or powder containing 8 to 30 atomic percent of R; 3 to 15 atomic percent of B; 0.01 to 5.0 atomic percent of at least one of Al, Si and V; balance Fe or Fe and Co and unavoidable impurities, the powder becomes less sensitive to the temperature fluctuation during the dehydrogenation, so that the obtained magnet powder becomes excellent in magnetic properties, particularly in coercivity and squareness of the magnetization curve.

The method in accordance with the present invention is hence characterized by the steps of (a) preparing a rare earth alloy material and a regenerative material; (b) subsequently carrying out the temperature elevation step in a hydrogen atmosphere and holding the alloy material and the regenerative material together in the same atmosphere at a temperature of 750° C. to 950° C.; (c) subsequently holding them at the same temperature in a vacuum; and (d) subsequently cooling and crushing the alloy.

In the foregoing, the alloy material may be homogenized at a temperature of 600° C. to 1200° C. prior to the above step (b). In addition, the resulted magnet powder may be further heat-treated at a temperature of 300° C. to 1000° C. to further improve the magnetic properties.

The manufacturing conditions and so on for the above process will be hereinafter explained.

(1) R-Fe-B alloy:

The R-Fe-B alloy material to be used may be usually in the form of ingots or in bulk, but may be in other forms such as flakes or powders. The alloy material should have a composition of 8 to 30 atomic percent of R; 3 to 15 atomic percent of B; 0.01 to 5.0 atomic percent of at least one of Al, Si and V; balance Fe and unavoidable impurities.

The reasons for the inclusion of the above elements and the numerical limitations are the same as described as to the permanent magnet powder. Therefore, a part of Fe may be substituted by 0.01 atomic percent to 40 atomic percent of Co as described previously. In addition, in order to enhance squareness of the magnetization curve, at least one element of Ti, Nb, Ta, Mo and W may be added such that the total content of the element and Al, Si or V amounts to 5.0 atomic percent at the most.

Furthermore, Al, Si and V may be deleted and Ga, Zr or Hf may be added instead. More specifically, the magnet alloy material may contain:

(i) 0.001 atomic percent to 5.0 atomic percent of Ga, (ii) 0.001 atomic percent to 5.0 atomic percent of Ga and 0.01 atomic percent to 3.0 atomic percent of one or more of Zr and Hf, or (iii) 0.01 atomic percent to 3.0 atomic percent of one or more of Zr and Hf. If the above modified R-Fe-B alloy is used, the magnetic anisotropy of the R-Fe-B magnet alloy can be further improved.

(2) Homogenization process

It is not necessarily required to homogenize the R-Fe-B alloy, but if homogenized, the resulting magnet powder exhibits more uniform magnetic properties. The homogenizing temperature is within the range of between 600° C. to 1200° C., preferably from 1050° C. to 1200° C. If the homogenizing temperature is less than 600° C., the homogenization process becomes time-consuming, so that the industrial productivity deteriorates. On the other hand, if the temperature exceeds 1200° C., the alloy will melt.

(3) Atmosphere in the temperature elevation process:

The temperature elevation step from room temperature to the temperature of 750° C. to 950° C. should be carried out in a hydrogen atmosphere. If the step is carried out in the above atmosphere, the reaction (1) occurs uniformly without causing fluctuations in phase transformation when compared with a vacuum or an argon atmosphere.

(4) Treating temperature in a hydrogen atmosphere and in a vacuum:

When the R-Fe-B alloy is kept in a hydrogen atmosphere at 500° C. to 1000° C., the phase transformation as indicated in the reaction (1) occurs, and when the alloy is then held in a vacuum at the same temperature, the phase transformation as indicated in the reaction (2) occurs. As a result, an aggregated structure of recrystallized grains is obtained. The phase transformations of the reactions (1) and (2) occur particularly at 750° C. to 950° C., and the aggregated structure of recrystallized grains thus obtained exhibits superior magnetic properties. Therefore, the treating temperature in a hydrogen atmosphere an in a vacuum is set to 750° C. to 950° C.

(5) Regenerative material:

Since the reaction (2) is endothermic, the temperature fluctuates during its lowering even though the temperature is maintained at a constant temperature ranging between 750° C. to 950° C. In order to prevent such fluctuation, the furnace temperature may be controlled during the phase transformation indicated by the reaction (2), but such a control is very difficult to attain on an industrial scale since special control equipment is required, and manufacturing costs are therefore increased unduly.

Therefore, in the present invention, the R-Fe-B alloy material is heated together with the regenerative material and held at a constant temperature of between 750° C. and 950° C. With this procedure, even though the endothermic reaction (2) occurs, the holding temperature of the R-Fe-B alloy material does not decrease due to the heat-conserving effect of the regenerative material.

The regenerative material should be a material which has a great heat content and a high melting point, and does not react with the R-fe-B alloy material in a hydrogen atmosphere or in a vacuum. In particular, ceramics such as alumina, magnesia and zirconia, or a metal having a high melting point such as tungsten, molybdenum or stainless steel can be preferably employed. The regenerative material should be in a form separable from the R-Fe-B magnet powder, and may be in the form of plates, blocks, lumps and balls.

The method of preventing the holding temperature from lowering by using the regenerative material will be hereinafter described with reference to the accompanying drawings.

Figure 3:
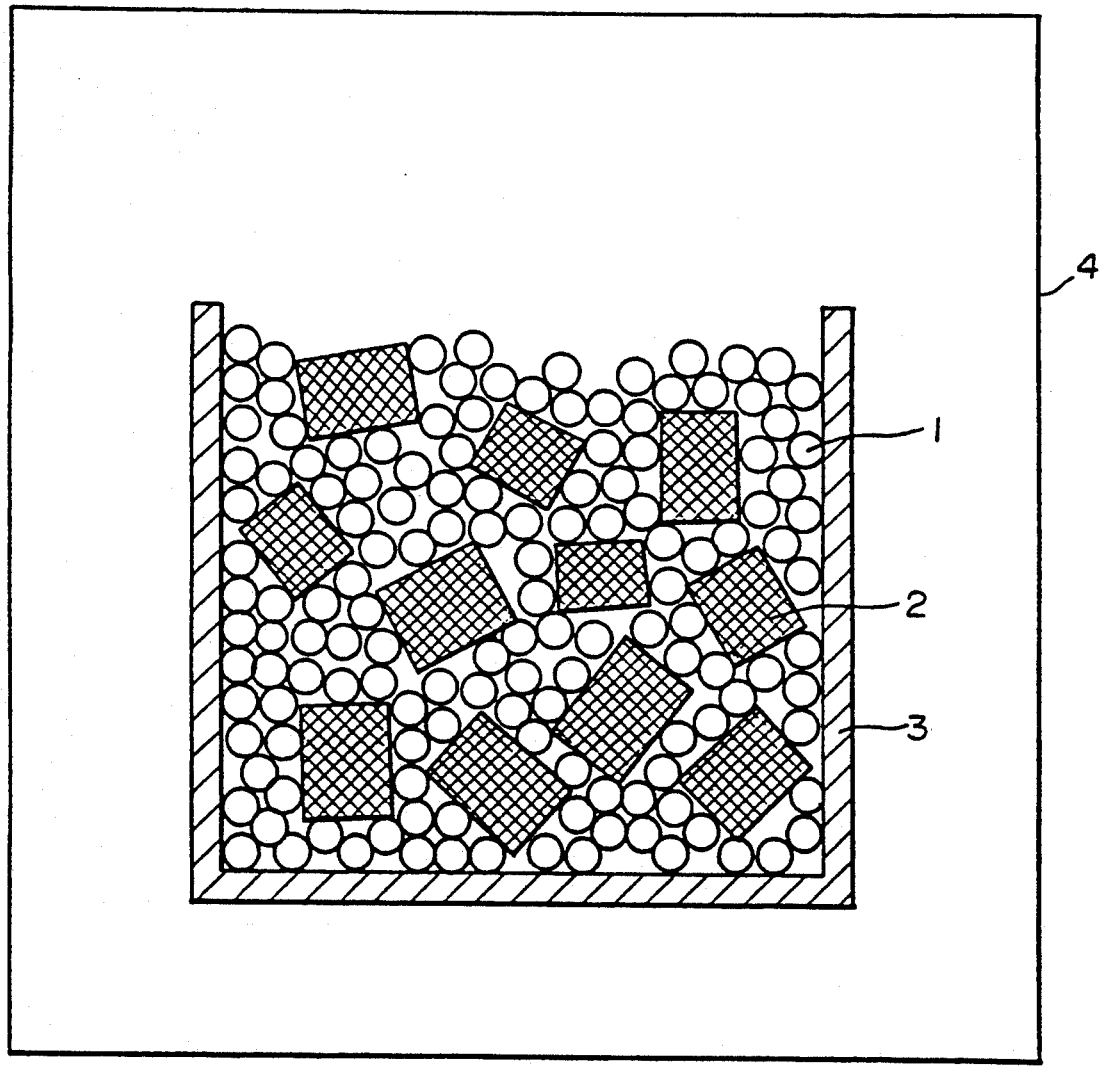
FIGS. 3 and 4 are schematic cross-sectional views, each showing the state in which R-Fe-B alloy ingots and regenerative materials are contained together in a vessel.
Figure 4:
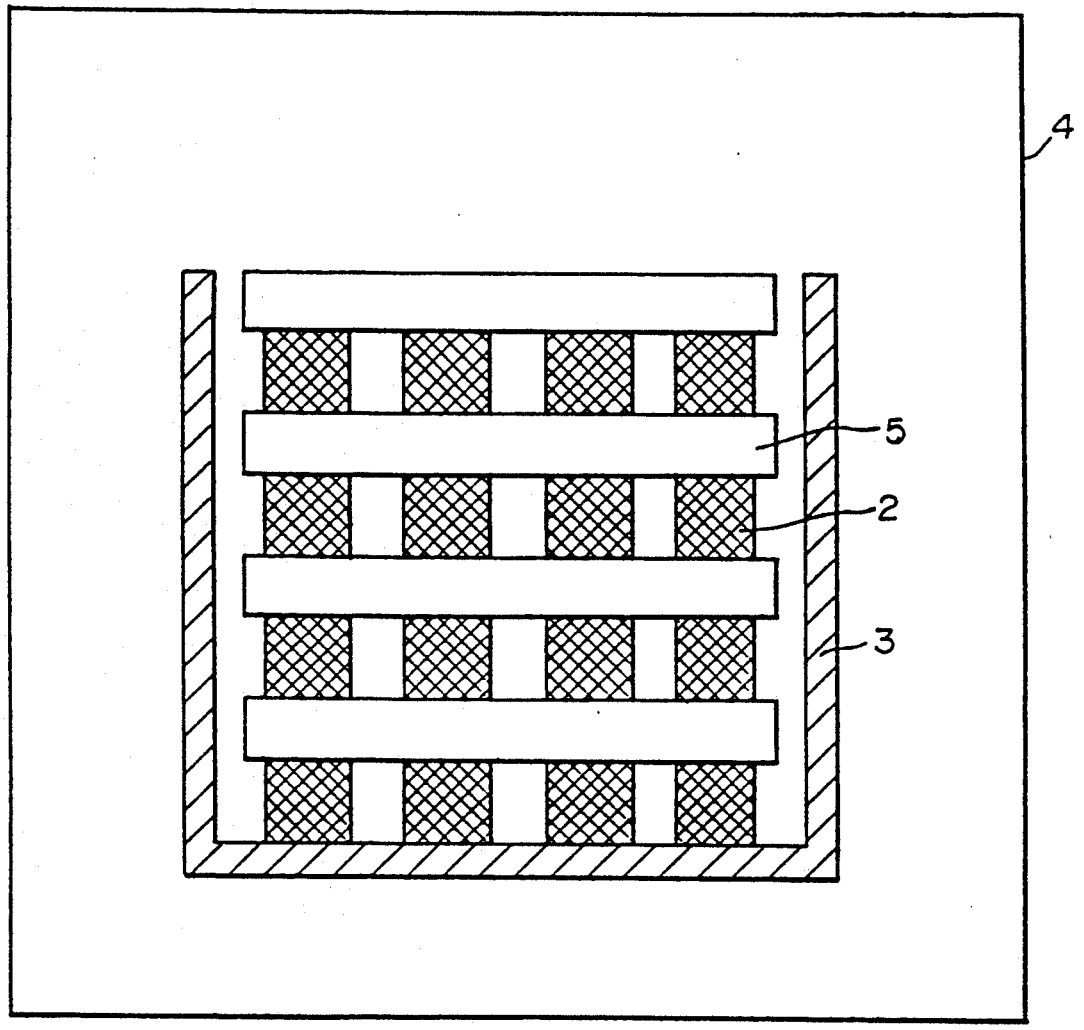

In FIGS. 3 and 4, R-Fe-B alloy ingots 2 in the form of blocks and regenerative materials in the form of balls 1 or plates 5 are both held in a vessel 3 arranged in a heating furnace 4, and the atmosphere in the heating furnace 4 is converted to a hydrogen atmosphere. Then, the R-Fe-B alloy ingot is subjected to hydrogenation while maintaining the furnace at a constant temperature of between 750° C. and 950° C. Subsequently, the furnace 4 is evacuated to carry out dehydrogenation. However, the regenerative materials 1 or 5, having high heat contents, are great are held in the vessel, and hence even though the endothermic reaction occurs in the dehydrogenation process, the holding temperature can be maintained constant without causing any fluctuation. Therefore, the reduction and variation of the magnetic properties can positively be prevented.

The invention will now be described in more detail by way of the following examples.

EXAMPLE 1

As shown in Tables 1-1 to 1-5, alloy ingots containing at least one of Ga, Zr and Hf as well as alloy ingots containing no Ga, Zr and Hf were prepared by means of plasma-melting and casting, and were then homogenized in an argon gas atmosphere at a temperature of 1120° C. for 40 hours. The ingots thus homogenized were crushed into alloy materials of about 20 mm in size. Then the alloy materials were heated in a hydrogen atmosphere of 1 atm to elevate their temperatures from the room temperature to 850° C., and were heat-treated by keeping them in the hydrogen atmosphere at 850° C. for four hours. Thereafter, the alloy materials were subjected to dehydrogenation at 830° C. until the pressure reached a vacuum of $1\times10^{-1}$ torr, and argon gas was then introduced to effect a rapid quenching. The materials were heat-treated in an argon gas atmosphere at 650° C. after the hydrogen treatment was completed. Then, the obtained alloy materials were crushed in mortars to produce magnet powders 1 to 28 of the invention, comparative magnet powders 1 to 11 and a prior art magnet powder 1. In addition, a part of the material alloy which was used to produce the prior art magnet powder 1 was subjected to hot pressing in a vacuum of $1\times10^{-3}$ torr at 680° C. until the density ratio was decreased to 98%, and was further subjected to plastic working at 750° C. until the height was reduced to ¼ thereof. This bulk material was then crushed so as to have an average particle size of 30 μm and a prior art magnet powder 2 was thus obtained.

The magnet powders 1 to 28 of the invention, the comparative magnet powders 1 to 11 and the prior art magnet powders 1 and 2 were then subjected to the following evaluation test. With respect to each magnet powder, the average size of the recrystallized grains and the amount (percent by volume) of the recrystallized grains for which a ratio of the greatest dimension to the smallest dimension is less than 2 was measured. In addition, these magnet powders were subjected to sieving to obtain magnet powders having particle sizes of 50 μm to 420 μm. Then, 100 g of each magnet powder thus obtained was subjected to an anticorrosion test by leaving it in an atmosphere of humidity of 95% and temperature of 80° C., and the percent change in weight due to oxidation of magnet powder after 1000 hours of the anticorrosion test was measured. The results are set forth in Tables 1-1 to 1-5.

Furthermore, the R-Fe-B magnet powder 3 of the invention was selected and observed by a transmission electron microscope. FIG. 1 is a photomicrograph of the powder. As will be seen from FIG. 1, it is found that recrystallized grains of $R_2Fe_{14}B$ phase having an average recrystallized grain size of 0.3 μm exists uniformly, that about 90% by volume of the recrystallized grains are the ones for which the ratio of the greatest dimension (b) to the smallest dimension (a) is less than 2, and that the magnet powder has an aggregated structure of recrystallized grains consisting essentially of recrystallized grains of $R_2Fe_{14}B$ phase.

Each of the magnet powders 1 to 28 of the invention, the comparative magnet powders 1 to 11 and the prior art magnet powders 1 and 2 was blended with 3.0% by weight of epoxy resin, and was subsequently subjected to pressing under a molding pressure of 6 ton/cm$^2$ in a magnetic field of 25 KOe or in the absence of the magnetic field. The resulting compacts were held at 120° C. for 2 hours to solidify the resin, and bonded magnets 1 to 28 of the invention, comparative bonded magnets 1 to 11 and prior art bonded magnets 1 and 2 were thus produced. The magnetic properties of the obtained bonded magnets were measured for evaluation.

It is seen from Tables 1-1 to 1-5 that the bonded magnets 1 to 28, which were obtained by molding in a magnetic field the permanent magnet powders containing at least one of Ga, Zr and Hf, are superior in magnetic properties, particularly in maximum energy product $(BH)_{max}$ and residual magnetic flux density Br, to the bonded magnets molded in the absence of a magnetic field, and have a superior magnetic anisotropy. However, as will be seen from the comparative bonded magnets 1 to 11, when Ga, Zr or Hf content of the magnet powder falls outside the range of the invention, the magnetic properties are lowered unduly. In addition, the prior art magnet powder 1, which contained no Ga, Zr and Hf, does not exhibit a sufficient magnetic anisotropy or corrosion resistance in the case where the manufacturing conditions are the same. Furthermore, the prior art magnet powder 2, in which the recrystallized grains were formed flat by means of hot plastic working and the amount of the recrystallized grains which had the ratio of the greatest dimension to the smallest dimension of less than 2 were about 40% by volume, is not so inferior in magnetic anisotropy to the magnet powders 1 to 28 of the invention, but the percent change in weight due to anticorrosion test is increased unduly, resulting in deterioration in corrosion resistance.

EXAMPLE 2

R-Fe-B alloy ingots, which contained at least one of Ga, Zr and Hf and further contained at least one of Al, V and Si as shown in Tables 2-1 and 2-2, were prepared, and the same procedures as in EXAMPLE 1 were repeated to produce permanent magnet powders 29 to 38 of the invention and comparative magnet powders 12 to 14. With respect to each magnet powder thus obtained, the percent by volume of the recrystallized grains for which the ratio of the greatest dimension to the smallest dimension was less than 2 were measured, and then the percent change in weight due to the anticorrosion test was similarly measured. Subsequently, the permanent magnet powders were subjected to pressing in a magnetic field or in the absence of the magnetic field to produce bonded magnets, and their magnetic properties were measured. The results are set forth in Tables 2-1 and 2-2.

It is seen from Tables 2-1 and 2-2 that when at least one of Al, V and Si was further added in a total amount of 0.01 to 2.0 atomic percent, the maximum energy product can be further improved, and the resulting magnet exhibits a better magnetic anisotropy.

EXAMPLE 3

As shown in Tables 3-1 to 3-5, R-Fe-Co-B alloy ingots containing at least one of Ga, Zr and Hf as well as R-Fe-Co-B alloy ingots containing no Ga, Zr and Hf and were prepared by means of plasma-melting and casting, and were then homogenized in an argon gas atmosphere at a temperature of 1120° C. for 40 hours. The ingots thus homogenized were crushed into alloy materials of about 20 mm in size. Then the alloy materials were heated in a hydrogen atmosphere of 1 atm to elevate their temperatures from room temperature to 850° C., and were heat-treated by keeping them in the hydrogen atmosphere at 850° C. for four hours. Thereafter, the alloy materials were subjected to dehydrogenation at 830° C. until the pressure reached a vacuum of $1\times10^{-1}$ torr, and argon gas was then introduced to effect a rapid quenching.

The materials thus obtained were crushed in mortars to produce magnet powders 39 to 74 of the invention, comparative magnet powders 15 to 24 and a prior art magnet powder 3. Each magnet powder had an average particle size of 30 μm. In addition, a part of the material alloy which was used to produce the prior art magnet powder 3 was subjected to hot pressing in a vacuum of $1\times10^{-3}$ torr at 660° C. until the ratio of density was decreased to 98%, and was further subjected to plastic working at 750° C. until the height was reduced to ¼ thereof. This bulk material was then crushed so as to have an average particle size of 30 μm, and a prior art magnet powder 4 was thus obtained.

The R-Fe-Co-B magnet powders 39 to 74 of the invention, the comparative magnet powders 15 to 24 and the prior art magnet powders 1 and 2 were then subjected to the following evaluation test. With respect to each magnet powder, the average size of the recrystallized grains and the amount (percent by volume) of the recrystallized grains for which a ratio of the greatest dimension to the smallest dimension is less than 2 were measured. In addition, these magnet powders were subjected to sieving to obtain magnet powders of 50 μm to 420 μm. Then, 100 g of each magnet powder thus obtained was subjected to an anticorrosion test by leaving it in an atmosphere of humidity of 95% and temperature of 80° C., and the percent change in weight due to oxidation of magnet powder after 1000 hours of the anticorrosion test was measured. The results are set forth in Tables 3-1 to 3-6.

Figure 2:
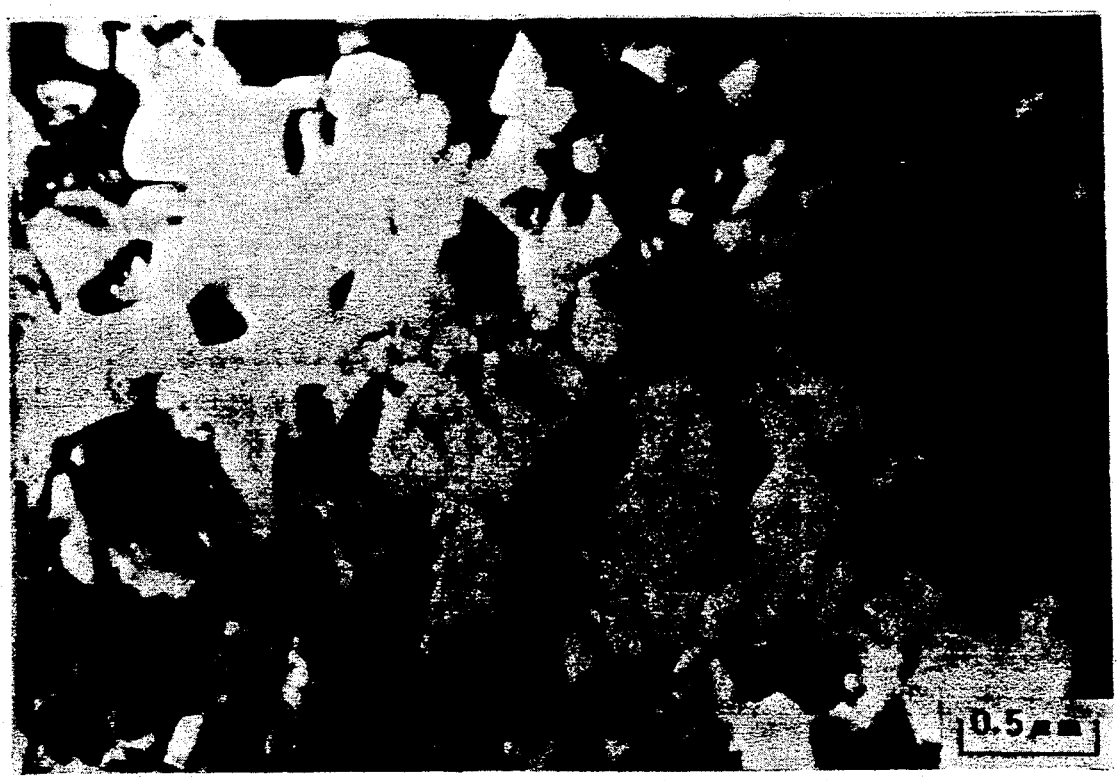
FIG. 2 is a photomicrograph similar to FIG. 1, but showing a microstructure of an R-Fe-Co-B permanent magnet powder in accordance with the present invention.

Furthermore, the magnet powder 63 of the invention was selected and observed by a transmission electron microscope. FIG. 2 is a photomicrograph of the powder. As will be seen from FIG. 2, it is found that recrystallized grains of $R_2(Fe,Co)_{14}B$ intermattalic compound phase having an average recrystallized grain size of 0.3 μm exists uniformly, that about 90% by volume of the recrystallized grains are the ones for which the ratio of the greatest dimension (b) to the smallest dimension (a) is less than 2, and that the magnet powder has an aggregated structure of recrystallized grains consisting essentially of recrystallized grains of the $R_2(Fe,Co)_{14}B$ phase.

Each of the magnet powders 39 to 74 of the invention, the comparative magnet powders 15 to 24 and the prior art magnet powders 3 and 4 was blended with 3.0% by weight of epoxy resin, and was subsequently subjected to pressing under a molding pressure of 6 ton/cm$^2$ in a magnetic field of 25 KOe or in the absence of the magnetic field. The resulting compacts were held at 120° C. for 2 hours to solidify the resin, and bonded magnets 39 to 74 of the invention, comparative bonded magnets 15 to 24 and prior art bonded magnets 3 and 4 were thus produced.

The magnetic properties of the obtained bonded magnets were then measured for evaluation.

It is seen from Tables 3-1 to 3-4 that the bonded magnets 39 to 74, obtained by molding in a magnetic field the permanent magnet powders are superior in magnetic properties, particularly in maximum energy product $(BH)_{max}$ and residual magnetic flux density Br, to the bonded magnets obtained by molding in the absence of a magnetic field, and hence the R-Fe-Co-B magnet powders 39 to 74 of the invention have a superior magnetic anisotropy. On the other hand, as will be seen from Tables 3-5 and 3-6, the comparative bonded magnets 15 to 24 have a reduced magnetic anisotropy and are inferior in magnetic properties.

In addition, the prior art magnet powder 3, which contained no Ga, Zr and Hf, fails to exhibit a sufficient magnetic anisotropy or corrosion resistance although the manufacturing conditions are the same. Furthermore, the prior art magnet powder 4, in which the recrystallized grains were formed flat by means of hot plastic working, and the amount of the recrystallized grains which had the ratio of the greatest dimension to the smallest dimension of less than 2, were about 40% by volume, is not so inferior in magnetic anisotropy to the magnet powders 39 to 74 of the invention, but the resistance to the corrosion is substantially lowered since the percent of change in weight in the anticorrosion test is great.

EXAMPLE 4

R-Fe-Co-B alloy ingots, which contained at least one of Ga, Zr and Hf and further contained at least one of Al, V and Si, as shown in Tables 4-1 and 4-2, were prepared, and the same procedures as in EXAMPLE 3 were repeated to produce permanent magnet powders 75 to 84 of the invention and comparative magnet powders 25 to 27 each having an average particle size of 30 μm. With respect to each magnet powder thus obtained, the percent by volume of the recrystallized grains for which the ratio of the greatest dimension to the smallest dimension was less than 2 were measured, and then the percent change in weight due to the anticorrosion test was similarly measured. Subsequently, the permanent magnet powders were subjected to pressing in a magnetic field or in the absence of the magnetic field to produce bonded magnets, and their magnetic properties were measured. The results are set forth in Tables 4-1 and 4-2.

It is seen from Tables 4-1 and 4-2 that when at least one of Al, V and Si is further added in a total amount of 0.01 to 2.0 atomic percent, the maximum energy product can be further improved, and the magnet exhibits a better magnetic anisotropy.

EXAMPLE 5

Magnet Powders 85 to 106 of the Invention

R-Fe-B or R-Fe-Co-B alloy ingots 85 to 106 having various compositions as shown in Table 5 were first prepared by means of plasma-melting and casting, and were homogenized in an argon gas atmosphere at a temperature of 1100° C. for 40 hours.

The ingots 85 to 106 thus homogenized were formed into cubic blocks of 10 to 30 mm in size to provide alloy block ingots.

Thereafter, alumina balls of 5 mm in diameter having a purity of 99.9% by weight were prepared as regenerative materials, and, as schematically shown in FIG. 3, the block ingots 2 and the alumina balls 1 were introduced in an alumina vessel 3 such that the ratio of the weight of the alloy block ingots to the regenerative materials was 1.0. Subsequently, the vessel was introduced in a heating furnace 4 and hydrogen was introduced into the furnace until the hydrogen pressure reached 760 torr, and the temperature in the furnace was elevated. After having maintained the hydrogen atmosphere of 850° C. for 3 hours, the furnace was evacuated while keeping the temperature at 850° C. for 1 hour until the pressure reached $1\times10^{-5}$ torr, and was then cooled.

Thereafter, the alloy ingots and the regenerative materials were separated from each other by sieving, and the alloy ingots were crushed in a Brown mill in an argon gas atmosphere until the average particle size was reduced to no greater than 500 μm. Thus, alloy magnet powders were obtained.

Each of the magnet powders thus obtained was blended with 3.0% by weight of epoxy resin, and was subsequently subjected to pressing under a molding pressure of 6 ton/cm$^2$ in a magnetic field of 20 KOe or in the absence of the magnetic field. The resulting compacts were held at 120° C. for 60 minutes to solidify the resin, and bonded magnets 85 to 106 were thus produced.

Subsequently, with respect to each bonded magnet, the magnetic properties such as magnetic flux density Br, coercivities iHc, maximum energy product BHmax and squareness of the demagnetization curve Hk/iHc, in which Hk denotes a magnetic field for Br×0.9 on a 4π-H curve, were measured for subsequent evaluation. The results are shown in Tables 6-1 to 6-3.

Comparative Powders 85 to 106

The R-Fe-B or R-Fe-Co-B alloy ingots 85 to 106 shown in Table 5 were homogenized and crushed into cubic blocks of 10 to 30 mm in size to provide alloy block ingots. Thereafter, without using the regenerative materials, only the block ingots were treated by the same procedures as that used to prepare the magnet powders 85 to 106 of the invention, and were crushed to provide alloy magnet powders. Then, the same procedures as that used to prepare the magnet powders 85 to 106 was repeated to produce bonded magnets, and their magnetic properties such as magnetic flux density Br, coercivities iHc, maximum energy product BHmax and squareness of the demagnetization curve Hk/iHc were measured for evaluation. The results are shown in Tables 7-1 to 7-3.

It is seen from Tables 6 and 7 that the bonded magnets obtained using the regenerative materials were superior in magnetic properties, particularly in coercivities and squareness of the magnetization curve, to the bonded magnets obtained without using the regenerative materials.

EXAMPLE 6

Powders 107 to 112 of the Invention & Comparative Powders 107 & 108

An alloy ingot having a composition of $Nd_{12.4}Pr_{0.2}Co_{15.5}Al_{0.5}Fe_{balance}$ was cut into cubes of 15 mm in size to provide alloy block ingots, and these ingots were homogenized in an argon gas atmosphere at 1150° C. for 20 hours.

Furthermore, stainless steel plates 5 mm thick having a purity of 99.9% by weight were prepared as regenerative materials, and, as schematically shown in FIG. 4, the block ingots 2 and the stainless steel plates 5 were introduced in a vessel 3 such that the ratio of the weight of the regenerative materials to the alloy block ingots was 3.0. Subsequently, the vessel was introduced in a heating furnace 4, and was heat-treated for 3 hours under the hydrogenation conditions as shown in Table 8. Then, the dehydrogenation was carried out under the conditions as shown in Table 8 for 1 hour to cool them. Thereafter, the stainless steel regenerative materials were removed, and the resulting alloy block ingots were crushed in a disk mill in an argon gas atmosphere until the average particle size was reduced to no more than 500 μm. Thus, alloy magnet powders were obtained.

Each of the magnet powders thus obtained was blended with 2.0% by weight of epoxy resin, and was subsequently subjected to pressing under a molding pressure of 6 ton/cm$^2$. The resulting compacts were held at 120° C. for 60 minutes to solidify the resin, and isotropic bonded magnets were thus produced. The magnetic properties of the resulted bonded magnets are set forth in Table 8.

As will be seen from Table 8, the isotropic bonded magnet manufactured using the magnet powder, which was produced by keeping the temperature of hydrogenation and dehydrogenation of 750° C. to 950° C., is superior in both the coercivity iHc and squareness Hk/iHc of the demagnetization curve, but if the temperature for the hydrogenation and dehydrogenation is less than 750° C., sufficient coercivities iHc cannot be obtained. On the other hand, if the temperature exceeds 950° C., the magnetic properties are reduced unduly. Furthermore, it is found that not only the non-metal material such as ceramics but also heat-resistant alloys such as stainless steel can be employed as the regenerative material.

EXAMPLE 7

Powders 113 to 128 of the Invention

R-Fe-B or R-Fe-Co-B alloy ingots 113 to 128 having various compositions as shown in Table 9 were first prepared by means of plasma-melting and casting, and the same procedures as in EXAMPLE 5 were repeated to alloy magnet powders and bonded magnets 113 to 128. The magnetic properties of the resulting bonded magnets are shown in Tables 10-1 and 10-2.

Comparative Powders 113 to 128

As was the case with EXAMPLE 5, the R-Fe-B or R-Fe-Co-B alloy ingots shown in Table 9 were homogenized and crushed into cubic blocks of 10 to 30 mm in size to provide alloy block ingots. Thereafter, the same procedures as in the comparative methods in EXAMPLE 5 were repeated to provide bonded magnets, and their magnetic properties were measured for evaluation. The results are shown in Tables 11-1 and 11-2.

It is seen from Tables 11-1 and 11-2 that when the ingots were subjected to hydrogenation and dehydrogenation using the regenerative materials, the resulting anisotropic bonded magnets obtained by the pressing in the presence of the magnetic field and the isotropic bonded magnets obtained by the pressing in the absence of the magnetic field are both excellent. Therefore, the alloy magnet powder has high magnetic properties.

Furthermore, the bonded magnets obtained from the magnet powder containing Ga, Zr or Hf are superior in magnetic anisotropy to the bonded magnets obtained from the magnet powder without such elements. Therefore, the addition of Ga, Zr or Hf improves the magnetic anisotropy of the magnet powder.

EXAMPLE 8

Powders 129 to 134 of the Invention and Comparative Powders 129 and 130

An alloy ingot having a composition of $Nd_{12.4}Pr_{0.2}Fe_{balance}Co_{10.1}B_{6.0}Ga_{0.5}$ was cut into cubes of 15 mm in size to provide alloy block ingots, and these ingots were homogenized in an argon gas atmosphere at 115° C. for 20 hours.

Furthermore, magnesia plates of 5 mm in thickness having a purity of 99.9% by weight were prepared as regenerative materials, and, as schematically shown in FIG. 4, the block ingots 2 and the magnesia plates 5 were introduced in a vessel 3 such that the ratio of the weight of the regenerative materials to the alloy block ingots was 2.0. Subsequently, the vessel was introduced in a heating furnace 4, and hydrogen was introduced into the furnace until the hydrogen pressure reached 1 atm. Then, the temperature in the furnace was elevated and heat-treatment was carried out for 3 hours under the hydrogenation conditions as shown in Table 5. Then, the dehydrogenation was carried out for 1 hour until the pressure reached $1\times10^{-5}$ torr to cool them. Thereafter, the magnesia plate regenerative materials were removed, and the resulting alloy block ingots were crushed in a disk mill in an argon gas atmosphere until the average particle size was reduced to no greater than 500 μm. Thus, alloy magnet powders were obtained.

Each of the magnet powders thus obtained was blended with 2.0% by weight of epoxy resin, and was subsequently subjected to pressing under a molding pressure of 6 ton/cm$^2$ in a magnetic field of 20 KOe. The resulting compacts were held at 120° C. for 60 minutes to solidify the resin, and isotropic bonded magnets were thus produced. The magnetic properties of the resulting bonded magnets are set forth in Table 1.

As will be seen from Table 12, the anisotropic bonded magnet manufactured using the magnet powder, which was produced by keeping the temperature of hydrogenation and dehydrogenation at 750° C. to 950° C., is superior in magnetic properties, particularly in maximum energy product (BH)max, and the magnet exhibits a better magnetic anisotropy.

TABLE 1

| | R—Fe—B permanent magnet powder Composition (Atomic %) | | | | | | | | | | | | | Presence of magnetic field upon pressing | Magnetic properties of bonded magnets | | |
|---|---|---|---|---|---|---|---|---|---|---|---|---|---|---|---|---|---|
| | Nd | Dy | Pr | Tb | B | Ga | Zr | Hf | Total amount | Fe | d (μm) | c (vol %) | f (wt %) | | Br (KG) | iHc (KOe) | $BH_{max}$ (MGOe) |
| Magnet powder of the invention | | | | | | | | | | | | | | | | | |
| 1 | 12.1 | 0.3 | — | — | 6.0 | 0.01 | — | — | 0.01 | Other | 0.2 | 95 | 0.295 | Present | 7.5 | 11.4 | 12.8 |
| | | | | | | | | | | | | | | Absent | 6.0 | 11.4 | 8.0 |
| 2 | 12.0 | 0.5 | — | — | 6.0 | 0.1 | — | — | 0.1 | Other | 0.4 | 80 | 0.290 | Present | 8.5 | 14.3 | 15.1 |
| | | | | | | | | | | | | | | Absent | 6.1 | 14.5 | 8.1 |
| 3 | 12.0 | — | 0.5 | — | 6.0 | 0.5 | — | — | 0.5 | Other | 0.3 | 90 | 0.274 | Present | 8.5 | 14.6 | 15.4 |
| | | | | | | | | | | | | | | Absent | 6.3 | 14.7 | 9.0 |
| 4 | 11.9 | 0.5 | — | — | 5.9 | 5.0 | — | — | 5.0 | Other | 0.5 | 80 | 0.152 | Present | 8.3 | 10.7 | 15.1 |
| | | | | | | | | | | | | | | Absent | 5.7 | 11.0 | 7.0 |
| 5 | 12.1 | — | 0.2 | 0.1 | 6.0 | — | 0.01 | — | 0.01 | Other | 0.2 | 90 | 0.288 | Present | 6.5 | 10.0 | 9.1 |
| | | | | | | | | | | | | | | Absent | 5.9 | 10.0 | 7.6 |
| 6 | 12.0 | — | 0.2 | 0.2 | 5.9 | — | 0.1 | — | 0.1 | Other | 0.4 | 90 | 0.275 | Present | 7.8 | 8.5 | 12.5 |
| | | | | | | | | | | | | | | Absent | 6.1 | 8.8 | 8.0 |
| 7 | 12.1 | — | 0.2 | 0.1 | 6.0 | — | 1.0 | — | 1.0 | Other | 0.5 | 85 | 0.182 | Present | 7.8 | 9.3 | 12.0 |
| | | | | | | | | | | | | | | Absent | 6.0 | 9.5 | 7.7 |
| 8 | 12.0 | — | 0.2 | 0.2 | 6.0 | — | 5.0 | — | 5.0 | Other | 1.0 | 100 | 0.177 | Present | 7.5 | 7.4 | 11.3 |
| | | | | | | | | | | | | | | Absent | 5.8 | 7.3 | 7.0 |
| 9 | 12.0 | 0.2 | 0.2 | — | 6.1 | — | — | 0.01 | 0.01 | Other | 0.3 | 85 | 0.280 | Present | 6.5 | 9.8 | 9.4 |
| | | | | | | | | | | | | | | Absent | 5.8 | 9.9 | 7.3 |
| 10 | 11.9 | 0.1 | 0.3 | — | 5.9 | — | — | 0.1 | 0.1 | Other | 0.4 | 80 | 0.254 | Present | 7.6 | 9.5 | 11.5 |
| | | | | | | | | | | | | | | Absent | 6.0 | 9.8 | 7.5 |
| 11 | 12.2 | 0.2 | 0.2 | — | 6.0 | — | — | 1.0 | 1.0 | Other | 0.4 | 90 | 0.201 | Present | 6.4 | 9.1 | 9.2 |
| | | | | | | | | | | | | | | Absent | 5.8 | 9.5 | 7.0 |
| 12 | 12.0 | 0.2 | 0.2 | — | 6.0 | — | — | 5.0 | 5.0 | Other | 0.5 | 85 | 0.179 | Present | 7.3 | 8.3 | 11.0 |
| | | | | | | | | | | | | | | Absent | 5.5 | 8.5 | 6.2 |
| 13 | 12.0 | 0.3 | — | — | 6.1 | — | 0.5 | 0.5 | 1.0 | Other | 0.6 | 95 | 0.198 | Present | 8.2 | 9.8 | 14.4 |
| | | | | | | | | | | | | | | Absent | 5.8 | 10.1 | 7.2 |
| 14 | 11.9 | 0.5 | — | — | 6.0 | — | 2.3 | 2.5 | 4.8 | Other | 1.0 | 75 | 0.180 | Present | 8.1 | 8.3 | 13.8 |
| | | | | | | | | | | | | | | Absent | 5.4 | 8.4 | 6.2 |
| 15 | 12.6 | — | — | — | 6.0 | 0.5 | 0.5 | 0.5 | 1.5 | Other | 0.5 | 90 | 0.210 | Present | 8.3 | 14.7 | 15.0 |
| | | | | | | | | | | | | | | Absent | 5.7 | 14.6 | 7.4 |
| 16 | 12.4 | — | — | — | 6.1 | 0.5 | 0.5 | — | 1.0 | Other | 0.4 | 80 | 0.266 | Present | 8.5 | 14.3 | 15.6 |
| | | | | | | | | | | | | | | Absent | 5.7 | 14.4 | 7.5 |
| 17 | 12.1 | — | — | — | 6.0 | 0.5 | — | 0.5 | 1.0 | Other | 0.3 | 70 | 0.258 | Present | 8.5 | 14.0 | 16.0 |
| | | | | | | | | | | | | | | Absent | 5.8 | 14.1 | 7.5 |
| 18 | 13.6 | — | 0.2 | — | 6.1 | 0.5 | — | 0.3 | 0.8 | Other | 1.0 | 60 | 0.358 | Present | 7.5 | 15.5 | 12.1 |
| | | | | | | | | | | | | | | Absent | 5.3 | 15.6 | 6.1 |
| 19 | 13.6 | — | 0.2 | — | 6.1 | 0.5 | — | 0.3 | 0.8 | Other | 1.5 | 50 | 0.379 | Present | 7.3 | 15.0 | 11.5 |
| | | | | | | | | | | | | | | Absent | 5.2 | 15.3 | 6.0 |
| 20 | 20.0 | — | — | — | 7.0 | 1.0 | — | 0.1 | 1.1 | Other | 0.8 | 85 | 0.985 | Present | 6.9 | 11.9 | 10.5 |
| | | | | | | | | | | | | | | Absent | 4.8 | 12.0 | 5.0 |
| 21 | 15.0 | — | — | — | 8.0 | 0.6 | — | 0.1 | 0.7 | Other | 0.5 | 85 | 0.626 | Present | 7.1 | 12.4 | 11.0 |
| | | | | | | | | | | | | | | Absent | 5.2 | 12.6 | 5.7 |
| 22 | 16.0 | — | — | — | 3.0 | — | — | 0.1 | 0.1 | Other | 0.4 | 70 | 0.687 | Present | 6.7 | 9.5 | 8.6 |
| | | | | | | | | | | | | | | Absent | 3.1 | 9.7 | 2.2 |
| 23 | 13.0 | — | — | — | 10.0 | — | 0.1 | 0.1 | 0.2 | Other | 0.5 | 75 | 0.360 | Present | 7.3 | 9.3 | 10.4 |
| | | | | | | | | | | | | | | Absent | 5.2 | 9.4 | 4.6 |

TABLE 1-continued

| | R—Fe—B permanent magnet powder Composition (Atomic %) | | | | | | | | | | | | | Presence of magnetic field upon pressing | Magnetic properties of bonded magnets | | |
|---|---|---|---|---|---|---|---|---|---|---|---|---|---|---|---|---|---|
| | Nd | Dy | Pr | Tb | B | Ga | Zr | Hf | Total amount | Fe | d (μm) | c (vol %) | f (wt %) | | Br (KG) | iHc (KOe) | $BH_{max}$ (MGOe) |
| 24 | 14.0 | — | — | — | 20.0 | — | 0.1 | 0.1 | 0.2 | Other | 1.0 | 90 | 0.575 | Present | 8.2 | 5.7 | 10.0 |
| | | | | | | | | | | | | | | Absent | 3.5 | 5.9 | 2.1 |
| 25 | 10.0 | — | — | — | 7.0 | 2.0 | — | — | 2.0 | Other | 0.6 | 80 | 0.186 | Present | 9.2 | 9.3 | 11.4 |
| | | | | | | | | | | | | | | Absent | 5.7 | 9.5 | 5.0 |
| 26 | 13.0 | — | — | — | 6.0 | 0.5 | — | — | 0.5 | Other | 5.0 | 95 | 0.525 | Present | 7.7 | 10.7 | 11.0 |
| | | | | | | | | | | | | | | Absent | 4.8 | 10.8 | 4.7 |
| 27 | 13.0 | — | — | — | 6.0 | 0.5 | — | — | 0.5 | Other | 10.0 | 85 | 0.608 | Present | 8.2 | 6.4 | 10.2 |
| | | | | | | | | | | | | | | Absent | 4.2 | 6.4 | 2.5 |
| 28 | 13.0 | — | — | — | 6.0 | 0.5 | — | — | 0.5 | Other | 20.0 | 90 | 0.974 | Present | 8.6 | 5.1 | 10.0 |
| | | | | | | | | | | | | | | Absent | 4.0 | 5.2 | 2.0 |
| Comparative magnet powder | | | | | | | | | | | | | | | | | |
| 1 | 12.1 | 0.4 | — | — | 5.9 | 7.0* | — | — | 7.0* | Other | 1.2 | 80 | 0.113 | Present | 6.2 | 9.7 | 8.0 |
| | | | | | | | | | | | | | | Absent | 5.5 | 9.9 | 6.0 |
| 2 | 12.3 | 0.3 | — | — | 6.0 | — | 7.0* | — | 7.0* | Other | 0.6 | 80 | 0.104 | Present | 6.1 | 4.2 | 4.2 |
| | | | | | | | | | | | | | | Absent | 5.1 | 4.4 | 4.1 |
| 3 | 12.2 | 0.3 | — | — | 6.1 | — | — | 7.0* | 7.0* | Other | 0.5 | 90 | 0.108 | Present | 5.5 | 5.1 | 4.2 |
| | | | | | | | | | | | | | | Absent | 5.0 | 5.0 | 3.9 |
| 4 | 11.9 | 0.4 | — | — | 6.0 | — | 3.5 | 3.4 | 6.9* | Other | 0.7 | 85 | 0.096 | Present | 6.0 | 7.3 | 7.7 |
| | | | | | | | | | | | | | | Absent | 5.1 | 7.3 | 5.4 |
| 5 | 12.2 | 0.3 | — | — | 6.0 | 3.5 | 3.5 | — | 7.0* | Other | 1.0 | 80 | 0.109 | Present | 6.7 | 12.1 | 8.6 |
| | | | | | | | | | | | | | | Absent | 5.5 | 12.3 | 7.0 |
| 6 | 12.2 | — | — | — | 6.1 | 0.4 | — | — | 0.4 | Other | 0.01* | 95 | 0.052 | Present | 2.5 | 0.2 | <1 |
| | | | | | | | | | | | | | | Absent | 2.0 | 0.3 | <1 |
| 7 | 12.4 | — | — | — | 6.0 | 0.4 | — | — | 0.4 | Other | 22* | 95 | 1.837 | Present | 4.2 | 1.1 | <1 |
| | | | | | | | | | | | | | | Absent | 2.3 | 1.3 | <1 |
| 8 | 25.0* | — | — | — | 7.0 | 1.0 | — | 0.2 | 1.2 | Other | 0.6 | 90 | 1.522 | Present | 1.8 | 1.3 | <1 |
| | | | | | | | | | | | | | | Absent | 1.5 | 1.5 | <1 |
| 9 | 8.0* | — | — | — | 7.0 | 2.0 | — | — | 2.0 | Other | 0.3 | 85 | 0.120 | Present | 3.5 | 0.2 | <1 |
| | | | | | | | | | | | | | | Absent | 2.0 | 0.2 | <1 |
| 10 | 16.0 | — | — | — | 2.0* | — | — | 0.1 | 0.1 | Other | 2.0 | 80 | 1.024 | Present | 2.5 | 0.2 | <1 |
| | | | | | | | | | | | | | | Absent | 1.2 | 0.2 | <1 |
| 11 | 14.0 | — | — | — | 25.0* | — | 0.1 | 0.1 | 0.2 | Other | 1.0 | 85 | 0.443 | Present | 3.3 | 0.2 | <1 |
| | | | | | | | | | | | | | | Absent | 2.0 | 0.3 | <1 |
| Prior art magnet powder | | | | | | | | | | | | | | | | | |
| 1 | 15.0 | — | — | — | 8.0 | — | — | — | — | Other | 0.4 | 90 | 0.745 | Present | 5.4 | 14.1 | 6.2 |
| | | | | | | | | | | | | | | Absent | 5.4 | 14.3 | 6.1 |
| 2 | 15.0 | — | — | — | 8.0 | — | — | — | — | Other | 0.8 | 40* | 1.142 | Present | 6.6 | 10.5 | 9.3 |
| | | | | | | | | | | | | | | Absent | 5.0 | 10.6 | 5.4 |

"d" denotes "average size of recrystallized grains".
"c" denotes "% by volume of recrystallized grains for which (greatest dimension)/(smallest dimension)<2".
"f" denotes "% increase in weight after 1000 hr anticorrosion test".
"*" denotes values out of the range of the invention

TABLE 2

| | R—Fe—B permanent magnet powder Composition (Atomic %) | | | | | | | | | | | | | | Presence of magnetic field upon pressing | Magnetic properties of bonded magnets | | |
|---|---|---|---|---|---|---|---|---|---|---|---|---|---|---|---|---|---|---|
| | Nd | B | Ga | Zr | Hr | Total amount | Al | V | Si | Total amount | Fe | d (μm) | c (vol %) | f (wt %) | | Br (KG) | iHc (KOe) | $BH_{max}$ (MGOe) |
| Magnet powder of the invention | | | | | | | | | | | | | | | | | | |
| 29 | 12.6 | 6.0 | 1.0 | — | — | 1.0 | 0.3 | — | — | 0.3 | Other | 0.3 | 80 | 0.223 | Present | 8.6 | 13.3 | 16.2 |
| | | | | | | | | | | | | | | | Absent | 6.0 | 13.5 | 7.9 |
| 30 | 12.6 | 6.0 | 1.0 | — | — | 1.0 | 0.1 | 0.1 | — | 0.2 | Other | 0.4 | 90 | 0.230 | Present | 8.6 | 12.9 | 16.0 |
| | | | | | | | | | | | | | | | Absent | 6.0 | 13.2 | 7.8 |
| 31 | 12.6 | 6.0 | 1.0 | — | — | 1.0 | 0.7 | — | — | 0.7 | Other | 0.3 | 85 | 0.203 | Present | 8.5 | 15.5 | 16.1 |
| | | | | | | | | | | | | | | | Absent | 5.9 | 15.4 | 7.4 |
| 32 | 12.6 | 6.0 | 1.0 | — | — | 1.0 | 2.0 | — | — | 2.0 | Other | 0.5 | 80 | 0.187 | Present | 8.5 | 13.4 | 16.0 |
| | | | | | | | | | | | | | | | Absent | 5.8 | 13.6 | 7.3 |
| 33 | 12.5 | 6.0 | 1.0 | — | — | 1.0 | — | 0.4 | — | 0.4 | Other | 0.1 | 95 | 0.205 | Present | 8.7 | 13.3 | 16.5 |
| | | | | | | | | | | | | | | | Absent | 5.9 | 13.4 | 7.8 |
| 34 | 12.5 | 6.0 | — | — | 0.3 | 0.3 | — | 0.2 | — | 0.2 | Other | 0.2 | 100 | 0.224 | Present | 7.8 | 9.6 | 13.0 |
| | | | | | | | | | | | | | | | Absent | 5.8 | 9.8 | 7.0 |
| 35 | 12.5 | 6.0 | 0.5 | — | — | 0.5 | — | — | 0.3 | 0.3 | Other | 0.4 | 85 | 0.210 | Present | 8.5 | 14.2 | 16.0 |
| | | | | | | | | | | | | | | | Absent | 6.1 | 14.3 | 8.1 |
| 36 | 12.5 | 6.0 | 0.3 | 0.1 | — | 0.4 | — | — | 0.4 | 0.4 | Other | 0.4 | 90 | 0.215 | Present | 8.6 | 13.7 | 16.4 |
| | | | | | | | | | | | | | | | Absent | 5.8 | 14.0 | 7.6 |
| 37 | 12.5 | 6.0 | 0.3 | — | 0.1 | 0.4 | — | — | 2.0 | 2.0 | Other | 0.5 | 90 | 0.193 | Present | 8.5 | 13.2 | 15.5 |
| | | | | | | | | | | | | | | | Absent | 5.8 | 13.3 | 7.0 |
| 38 | 12.5 | 6.0 | 0.3 | — | — | 0.3 | 0.3 | 0.3 | 0.3 | 0.9 | Other | 0.8 | 80 | 0.196 | Present | 8.2 | 11.1 | 14.5 |
| | | | | | | | | | | | | | | | Absent | 5.5 | 11.3 | 6.2 |

| | R—Fe—B permanent magnet powder Composition (Atomic %) | | | | | | | | | | | | | | Presence of magnetic field upon pressing | Magnetic properties of bonded magnets | | |
|---|---|---|---|---|---|---|---|---|---|---|---|---|---|---|---|---|---|---|
| | Nd | Dy | Pr | Tb | B | Ga | Zr | Hf | Total amount | Fe | d (μm) | c (vol %) | f (wt %) | | | Br (KG) | iHc (KOe) | $BH_{max}$ (MGOe) |
| Comparative magnet powder | | | | | | | | | | | | | | | | | | |
| 12 | 12.6 | — | — | — | 6.0 | 0.5 | — | — | 3.0 Al※ | Other | 0.5 | 80 | 0.158 | Present | | 7.8 | 10.3 | 12.1 |
| | | | | | | | | | | | | | | Absent | | 5.8 | 10.5 | 6.6 |
| 13 | 12.6 | — | — | — | 6.0 | 0.5 | — | — | 3.0 V※ | Other | 0.8 | 85 | 0.174 | Present | | 7.3 | 10.1 | 10.5 |
| | | | | | | | | | | | | | | Absent | | 5.7 | 10.4 | 6.3 |
| 14 | 12.6 | — | — | — | 6.0 | 0.5 | — | — | 3.0 Si※ | Other | 0.5 | 80 | 0.170 | Present | | 7.5 | 12.4 | 11.6 |
| | | | | | | | | | | | | | | Absent | | 5.8 | 12.6 | 7.2 |

"d" denotes "average size of recrystallized grains".
"c" denotes "% by volume of recrystallized grains for which (greatest dimension)/(smallest dimension)<2".
"f" denotes "% increase in weight after 1000 hr anticorrosion test".
"※" denotes values out of the range of the invention

TABLE 3

| Magnet powder of the invention | R—Fe—Co—B permanent magnet powder Composition (Atomic %) Nd | Tb | Dy | Pr | Co | B | Ga | Zr | Hf | Total amount | Fe | d (μm) | c (vol %) | f (wt %) | Presence of magnetic field upon pressing | Magnetic properties of bonded magnets Br (KG) | iHc (KOe) | $BH_{max}$ (MGOe) |
|---|---|---|---|---|---|---|---|---|---|---|---|---|---|---|---|---|---|---|
| 39 | 12.6 | — | — | — | 7.0 | 6.0 | 0.01 | — | — | 0.01 | Other | 0.4 | 90 | 0.254 | Present | 7.6 | 10.3 | 12.0 |
| | | | | | | | | | | | | | | | Absent | 6.0 | 10.5 | 7.9 |
| 40 | 12.4 | — | — | — | 7.1 | 6.0 | 0.1 | — | — | 0.1 | Other | 0.3 | 90 | 0.255 | Present | 8.6 | 12.4 | 15.7 |
| | | | | | | | | | | | | | | | Absent | 6.2 | 12.4 | 8.1 |
| 41 | 12.4 | — | — | — | 7.1 | 5.9 | 1.0 | — | — | 1.0 | Other | 0.3 | 80 | 0.205 | Present | 8.7 | 13.3 | 16.5 |
| | | | | | | | | | | | | | | | Absent | 6.4 | 13.6 | 9.3 |
| 42 | 12.5 | — | — | — | 7.1 | 6.1 | 2.0 | — | — | 2.0 | Other | 0.4 | 85 | 0.199 | Present | 8.5 | 11.5 | 15.1 |
| | | | | | | | | | | | | | | | Absent | 6.1 | 11.4 | 8.0 |
| 43 | 12.5 | — | — | — | 7.0 | 6.1 | 5.0 | — | — | 5.0 | Other | 0.6 | 90 | 0.185 | Present | 8.3 | 10.8 | 14.2 |
| | | | | | | | | | | | | | | | Absent | 5.8 | 10.8 | 7.3 |
| 44 | 12.6 | — | — | — | 7.0 | 6.0 | — | 0.01 | — | 0.01 | Other | 0.2 | 85 | 0.250 | Present | 7.3 | 10.3 | 11.0 |
| | | | | | | | | | | | | | | | Absent | 5.9 | 10.4 | 7.5 |
| 45 | 12.4 | — | — | — | 6.9 | 6.0 | — | 0.1 | — | 0.1 | Other | 0.3 | 80 | 0.241 | Present | 8.3 | 8.0 | 14.0 |
| | | | | | | | | | | | | | | | Absent | 5.9 | 8.2 | 7.1 |
| 46 | 12.4 | — | — | — | 7.0 | 6.1 | — | 1.0 | — | 1.0 | Other | 0.2 | 90 | 0.166 | Present | 7.0 | 8.4 | 10.5 |
| | | | | | | | | | | | | | | | Absent | 5.9 | 8.7 | 7.1 |
| 47 | 12.6 | — | — | — | 7.0 | 6.0 | — | 2.0 | 0.1 | 2.1 | Other | 0.4 | 75 | 0.156 | Present | 8.2 | 8.5 | 13.5 |
| | | | | | | | | | | | | | | | Absent | 5.7 | 8.5 | 6.6 |
| 48 | 12.5 | — | — | — | 7.0 | 6.1 | — | 4.8 | 0.1 | 4.9 | Other | 0.4 | 80 | 0.124 | Present | 8.0 | 7.3 | 12.8 |
| | | | | | | | | | | | | | | | Absent | 5.4 | 7.6 | 6.0 |
| 49 | 12.4 | — | — | — | 7.0 | 6.2 | — | — | 0.01 | 0.01 | Other | 0.2 | 85 | 0.265 | Present | 7.7 | 10.6 | 12.0 |
| | | | | | | | | | | | | | | | Absent | 6.1 | 10.7 | 7.6 |
| 50 | 12.3 | — | — | — | 7.0 | 5.9 | — | — | 0.1 | 0.1 | Other | 0.2 | 90 | 0.250 | Present | 8.5 | 9.5 | 15.1 |
| | | | | | | | | | | | | | | | Absent | 5.9 | 9.8 | 7.5 |
| 51 | 12.5 | — | — | — | 6.8 | 6.0 | — | — | 1.0 | 1.0 | Other | 0.6 | 85 | 0.198 | Present | 7.4 | 8.2 | 11.9 |
| | | | | | | | | | | | | | | | Absent | 5.9 | 8.5 | 7.4 |
| 52 | 12.4 | — | — | — | 7.1 | 6.1 | — | 0.1 | 2.0 | 2.1 | Other | 1.2 | 85 | 0.188 | Present | 8.4 | 8.7 | 15.0 |
| | | | | | | | | | | | | | | | Absent | 5.7 | 8.7 | 7.1 |
| 53 | 12.6 | — | — | — | 7.1 | 6.1 | — | 0.1 | 4.8 | 4.9 | Other | 1.0 | 80 | 0.190 | Present | 8.4 | 7.3 | 14.2 |
| | | | | | | | | | | | | | | | Absent | 5.3 | 7.2 | 6.3 |
| 54 | 12.2 | — | — | 0.3 | 17.0 | 6.0 | 0.001 | 0.001 | 0.001 | 0.003 | Other | 0.2 | 90 | 0.153 | Present | 7.5 | 10.5 | 12.4 |
| | | | | | | | | | | | | | | | Absent | 6.0 | 10.8 | 7.8 |
| 55 | 12.5 | — | 0.3 | — | 11.5 | 6.0 | 0.5 | 0.5 | 0.5 | 1.5 | Other | 0.5 | 80 | 0.163 | Present | 7.8 | 10.3 | 12.1 |
| | | | | | | | | | | | | | | | Absent | 5.8 | 10.5 | 6.8 |
| 56 | 12.2 | — | — | — | 16.5 | 6.0 | 0.4 | — | — | 0.4 | Other | 0.2 | 85 | 0.150 | Present | 8.8 | 13.6 | 17.5 |
| | | | | | | | | | | | | | | | Absent | 6.0 | 13.8 | 7.9 |
| 57 | 12.2 | — | — | — | 16.8 | 6.0 | 0.3 | — | 0.1 | 0.4 | Other | 0.2 | 85 | 0.135 | Present | 9.0 | 13.0 | 18.0 |
| | | | | | | | | | | | | | | | Absent | 6.1 | 13.5 | 8.0 |
| 58 | 10.0 | — | — | — | 5.0 | 8.1 | 1.5 | — | — | 1.5 | Other | 0.1 | 85 | 0.155 | Present | 8.8 | 8.6 | 12.5 |
| | | | | | | | | | | | | | | | Absent | 5.5 | 8.8 | 4.6 |
| 59 | 15.1 | — | — | — | 11.5 | 8.0 | 0.6 | — | 0.1 | 0.7 | Other | 0.3 | 100 | 0.475 | Present | 7.2 | 12.0 | 11.2 |
| | | | | | | | | | | | | | | | Absent | 5.3 | 12.5 | 5.8 |
| 60 | 20.0 | — | — | — | 11.8 | 7.0 | 1.0 | — | 0.1 | 1.1 | Other | 0.4 | 90 | 0.643 | Present | 6.9 | 12.3 | 10.6 |
| | | | | | | | | | | | | | | | Absent | 4.9 | 12.5 | 5.0 |
| 61 | 12.2 | — | 0.2 | — | 0.1 | 6.0 | 0.5 | — | — | 0.5 | Other | 0.2 | 90 | 0.260 | Present | 8.6 | 14.4 | 15.7 |
| | | | | | | | | | | | | | | | Absent | 6.3 | 14.5 | 8.2 |

TABLE 3-continued

| | R—Fe—Co—B permanent magnet powder Composition (Atomic %) | | | | | | | | | | | | | | Presence of magnetic field upon pressing | Magnetic properties of bonded magnets | | |
|---|---|---|---|---|---|---|---|---|---|---|---|---|---|---|---|---|---|---|
| | Nd | Tb | Dy | Pr | Co | B | Ga | Zr | Hf | Total amount | Fe | d (μm) | c (vol %) | f (wt %) | | Br (KG) | iHc (KOe) | $BH_{max}$ (MGOe) |
| 62 | 12.4 | 0.2 | — | — | 5.2 | 6.0 | 0.5 | — | — | 0.5 | Other | 0.4 | 95 | 0.244 | Present | 8.6 | 14.5 | 16.0 |
| | | | | | | | | | | | | | | | Absent | 6.1 | 14.6 | 8.1 |
| 63 | 12.5 | — | — | 0.1 | 11.5 | 6.0 | 0.5 | — | — | 0.5 | Other | 0.3 | 90 | 0.205 | Present | 8.8 | 14.0 | 16.5 |
| | | | | | | | | | | | | | | | Absent | 6.1 | 14.3 | 8.2 |
| 64 | 12.2 | — | 0.2 | — | 30.0 | 6.0 | 0.5 | 0.05 | — | 0.55 | Other | 0.1 | 85 | 0.108 | Present | 7.5 | 9.8 | 11.8 |
| | | | | | | | | | | | | | | | Absent | 5.6 | 10.0 | 6.0 |
| 65 | 12.3 | 0.2 | — | — | 50.0 | 6.0 | 0.4 | — | — | 0.4 | Other | 0.5 | 90 | 0.055 | Present | 7.6 | 8.3 | 10.6 |
| | | | | | | | | | | | | | | | Absent | 4.8 | 8.5 | 4.0 |
| 66 | 16.0 | — | — | — | 11.2 | 3.0 | — | — | 0.1 | 0.1 | Other | 0.3 | 80 | 0.488 | Present | 8.5 | 9.8 | 10.8 |
| | | | | | | | | | | | | | | | Absent | 3.1 | 10.1 | 2.1 |
| 67 | 12.1 | — | — | 0.5 | 6.4 | 10.4 | — | 0.5 | 0.5 | 1.0 | Other | 0.5 | 80 | 0.251 | Present | 8.3 | 10.1 | 14.0 |
| | | | | | | | | | | | | | | | Absent | 5.6 | 10.3 | 6.8 |
| 68 | 14.0 | — | — | — | 11.0 | 20.0 | — | 0.1 | 0.1 | 0.2 | Other | 0.4 | 80 | 0.394 | Present | 8.2 | 6.5 | 10.4 |
| | | | | | | | | | | | | | | | Absent | 3.5 | 6.7 | 2.1 |
| 69 | 13.2 | — | 0.3 | — | 11.5 | 6.1 | 0.5 | — | 0.2 | 0.7 | Other | 0.8 | 60 | 0.224 | Present | 7.6 | 16.0 | 12.0 |
| | | | | | | | | | | | | | | | Absent | 5.4 | 16.2 | 6.2 |
| 70 | 13.2 | — | 0.3 | — | 11.5 | 6.1 | 0.5 | — | 0.2 | 0.7 | Other | 1.0 | 50 | 0.305 | Present | 7.2 | 15.4 | 10.2 |
| | | | | | | | | | | | | | | | Absent | 5.2 | 15.5 | 5.5 |
| 71 | 12.4 | — | — | 0.2 | 11.5 | 6.0 | 0.5 | — | 0.1 | 0.6 | Other | 0.05 | 90 | 0.185 | Present | 8.5 | 13.1 | 15.6 |
| | | | | | | | | | | | | | | | Absent | 6.0 | 13.5 | 8.0 |
| 72 | 16.0 | — | — | — | 11.3 | 6.0 | 0.5 | — | — | 0.5 | Other | 5.0 | 85 | 0.466 | Present | 7.9 | 11.2 | 11.0 |
| | | | | | | | | | | | | | | | Absent | 4.9 | 11.5 | 4.8 |
| 73 | 16.0 | — | — | — | 11.3 | 6.0 | 0.5 | — | — | 0.5 | Other | 10.0 | 70 | — | Present | 8.3 | 6.6 | 10.3 |
| | | | | | | | | | | | | | | | Absent | 4.2 | 6.8 | 2.8 |
| 74 | 16.0 | — | — | — | 11.3 | 6.0 | 0.5 | — | — | 0.5 | Other | 20.0 | 80 | — | Present | 8.6 | 5.4 | 10.1 |
| | | | | | | | | | | | | | | | Absent | 3.2 | 5.5 | 1.2 |
| Comparative magnet powder | | | | | | | | | | | | | | | | | | |
| 15 | 12.5 | — | 0.5 | — | 7.0 | 6.0 | 0.5 | — | 0.5 | 1.0 | Other | 0.01※ | 85 | 0.040 | Present | 5.4 | 5.3 | 3.6 |
| | | | | | | | | | | | | | | | Absent | 3.2 | 5.3 | <1 |
| 16 | 12.5 | — | 0.4 | — | 7.0 | 6.0 | 0.5 | 0.5 | 0.5 | 1.5 | Other | 23※ | 80 | 1.775 | Present | 4.0 | 0.8 | <1 |
| | | | | | | | | | | | | | | | Absent | 2.2 | 0.7 | <1 |
| 17 | 12.3 | — | — | — | 7.1 | 6.1 | 7.9※ | — | — | 7.9※ | Other | 0.5 | 85 | 0.095 | Present | 6.0 | 10.0 | 7.7 |
| | | | | | | | | | | | | | | | Absent | 5.6 | 10.1 | 6.8 |
| 18 | 12.4 | — | — | — | 7.2 | 5.9 | — | 7.0※ | 0.2 | 7.2※ | Other | 0.6 | 70 | 0.088 | Present | 6.1 | 4.6 | 6.8 |
| | | | | | | | | | | | | | | | Absent | 5.2 | 4.7 | 4.7 |
| 19 | 12.5 | — | — | — | 7.0 | 5.9 | — | 0.2 | 6.7※ | 6.9※ | Other | 0.5 | 80 | 0.093 | Present | 5.8 | 5.4 | 6.3 |
| | | | | | | | | | | | | | | | Absent | 5.1 | 5.5 | 5.0 |
| 20 | 9.0※ | — | — | — | 16.2 | 7.0 | 2.0 | — | — | 2.0 | Other | 2.0 | 90 | 0.104 | Present | 3.5 | 0.2 | <1 |
| | | | | | | | | | | | | | | | Absent | 2.1 | 0.2 | <1 |
| 21 | 25.0※ | — | — | — | 16.5 | 7.0 | 1.0 | — | 0.2 | 1.2 | Other | 5.0 | 80 | 1.462 | Present | 1.6 | 1.6 | <1 |
| | | | | | | | | | | | | | | | Absent | 1.3 | 1.8 | <1 |
| 22 | 13.0 | — | — | — | 55.1※ | 7.0 | 1.0 | — | 0.5 | 1.5 | Other | 0.5 | 85 | 0.066 | Present | 4.5 | 7.5 | 3.3 |
| | | | | | | | | | | | | | | | Absent | 4.0 | 7.6 | 2.5 |
| 23 | 16.0 | — | — | — | 11.2 | 2.0※ | — | — | 0.1 | 0.1 | Other | 2.0 | 85 | 0.944 | Present | 2.7 | 0.2 | <1 |
| | | | | | | | | | | | | | | | Absent | 1.3 | 0.3 | <1 |
| 24 | 14.0 | — | — | — | 11.2 | 21.7※ | — | 0.1 | 0.1 | 0.2 | Other | 1.0 | 90 | 0.406 | Present | 3.5 | 0.2 | <1 |
| | | | | | | | | | | | | | | | Absent | 2.0 | 0.3 | <1 |

TABLE 3-continued

| | R—Fe—Co—B permanent magnet powder Composition (Atomic %) | | | | | | | | | | | | | | Presence of magnetic field upon pressing | Magnetic properties of bonded magnets | | |
|---|---|---|---|---|---|---|---|---|---|---|---|---|---|---|---|---|---|---|
| | Nd | Tb | Dy | Pr | Co | B | Ga | Zr | Hf | Total amount | Fe | d (μm) | c (vol %) | f (wt %) | | Br (KG) | iHc (KOe) | $BH_{max}$ (MGOe) |
| Prior art magnet powder | | | | | | | | | | | | | | | | | | |
| 3 | 14.5 | — | 0.4 | — | 7.2 | 6.0 | — | — | — | — | Other | 0.4 | 95 | 0.664 | Present | 5.6 | 14.0 | 6.8 |
| | | | | | | | | | | | | | | | Absent | 5.5 | 14.2 | 6.5 |
| 4 | 14.5 | — | 0.4 | — | 7.2 | 6.0 | — | — | — | — | Other | 1.0 | 40* | 1.038 | Present | 7.1 | 11.2 | 10.2 |
| | | | | | | | | | | | | | | | Absent | 5.1 | 11.3 | 5.5 |

"d" denotes "average size of recrystallized grains".
"c" denotes "% by volume of recrystallized grains for which (greatest dimension)/(smallest dimension)<2".
"f" denotes "% increase in weight after 1000 hr anticorrosion test".
" * " denotes values out of the range of the invention

TABLE 4

| | R—Fe—B permanent magnet powder Composition (Atomic %) | | | | | | | | | | | | | | | Presence of magnetic field upon pressing | Magnetic properties of bonded magnets | | |
|---|---|---|---|---|---|---|---|---|---|---|---|---|---|---|---|---|---|---|---|
| | Nd | Co | B | Ga | Zr | Hf | Total amount | Al | V | Si | Total amount | Fe | d (μm) | c (vol %) | f (wt %) | | Br (KG) | iHc (KOe) | $BH_{max}$ (MGOe) |
| **Magnet powder of the invention** | | | | | | | | | | | | | | | | | | | |
| 75 | 12.4 | 7.6 | 6.0 | 1.0 | — | — | 1.0 | 0.1 | — | — | 0.1 | Other | 0.2 | 80 | 0.194 | Present | 8.9 | 13.2 | 17.6 |
| | | | | | | | | | | | | | | | | Absent | 6.1 | 13.3 | 8.2 |
| 76 | 12.5 | 11.3 | 6.0 | 1.0 | — | — | 1.0 | 0.4 | — | — | 0.4 | Other | 0.3 | 90 | 0.186 | Present | 9.1 | 13.5 | 18.5 |
| | | | | | | | | | | | | | | | | Absent | 6.2 | 13.6 | 8.3 |
| 77 | 12.4 | 7.4 | 5.9 | 1.0 | — | — | 1.0 | — | 0.5 | — | 0.5 | Other | 0.2 | 95 | 0.178 | Present | 8.9 | 10.5 | 17.2 |
| | | | | | | | | | | | | | | | | Absent | 6.0 | 10.5 | 8.1 |
| 78 | 12.3 | 7.4 | 6.0 | 0.5 | — | — | 0.5 | — | — | 2.0 | 2.0 | Other | 0.4 | 80 | 0.180 | Present | 9.0 | 12.2 | 18.2 |
| | | | | | | | | | | | | | | | | Absent | 6.0 | 12.3 | 7.8 |
| 79 | 12.3 | 11.4 | 6.0 | 0.1 | 0.1 | — | 0.2 | 0.5 | 0.2 | 0.5 | 1.2 | Other | 0.5 | 75 | 0.163 | Present | 8.9 | 12.3 | 18.0 |
| | | | | | | | | | | | | | | | | Absent | 5.8 | 12.5 | 7.6 |
| 80 | 12.4 | 11.3 | 6.0 | — | — | 0.1 | 0.1 | — | — | 0.4 | 0.5 | Other | 0.4 | 80 | 0.173 | Present | 8.8 | 10.1 | 17.2 |
| | | | | | | | | | | | | | | | | Absent | 6.0 | 10.4 | 7.9 |
| 81 | 12.0 | 11.4 | 6.0 | — | 1.0 | 1.0 | 2.0 | 0.3 | — | 0.1 | 0.4 | Other | 0.3 | 80 | 0.147 | Present | 8.6 | 11.0 | 17.0 |
| | | | | | | | | | | | | | | | | Absent | 5.7 | 11.5 | 7.1 |
| 82 | 12.1 | 16.8 | 6.0 | 0.2 | 0.1 | 0.1 | 0.4 | 2.0 | — | — | 2.0 | Other | 0.2 | 90 | 0.142 | Present | 9.0 | 12.0 | 18.0 |
| | | | | | | | | | | | | | | | | Absent | 5.7 | 12.3 | 7.1 |
| 83 | 12.2 | 16.5 | 6.0 | — | — | 0.1 | 0.1 | 0.5 | — | — | 0.5 | Other | 0.2 | 95 | 0.155 | Present | 9.1 | 11.4 | 18.2 |
| | | | | | | | | | | | | | | | | Absent | 6.1 | 11.8 | 8.0 |
| 84 | 12.2 | 16.5 | 6.0 | 0.5 | — | — | 0.5 | 0.02 | 0.01 | 0.02 | 0.05 | Other | 0.5 | 90 | 0.197 | Present | 8.9 | 13.2 | 18.0 |
| | | | | | | | | | | | | | | | | Absent | 6.0 | 13.4 | 7.8 |
| **Comparative magnet powder** | | | | | | | | | | | | | | | | | | | |
| 25 | 12.5 | 11.4 | 6.0 | 0.5 | — | — | 0.5 | 3.0 | — | — | 3.0※ | Other | 0.8 | 80 | 0.144 | Present | 7.6 | 10.5 | 10.8 |
| | | | | | | | | | | | | | | | | Absent | 5.9 | 10.8 | 7.2 |
| 26 | 12.4 | 11.4 | 6.0 | 0.5 | — | — | 0.5 | — | 3.0 | — | 3.0※ | Other | 0.4 | 85 | 0.170 | Present | 7.4 | 10.6 | 10.2 |
| | | | | | | | | | | | | | | | | Absent | 5.7 | 10.8 | 6.5 |
| 27 | 12.5 | 11.4 | 6.0 | 0.5 | — | — | 0.5 | — | — | 3.0 | 3.0※ | Other | 0.3 | 70 | 0.163 | Present | 7.6 | 11.3 | 11.8 |
| | | | | | | | | | | | | | | | | Absent | 5.8 | 11.5 | 7.3 |

"d" denotes "average size of recrystallized grains".
"c" denotes "% by volume of recrystallized grains for which (greatest dimension)/(smallest dimension)<2".
"f" denotes "% increase in weight after 1000 hr anticorrosion test".
" ※ " denotes values out of the range of the invention

TABLE 5

| R—Fe—B alloy ingots | Composition (Atomic %) | | | | | | | | | |
|---|---|---|---|---|---|---|---|---|---|---|
| | Nd | Pr | Dy | Co | B | Al | Si | V | Additional element | Fe & impurities |
| 85 | 12.1 | 0.2 | — | 16.5 | 6.5 | — | — | — | — | other |
| 86 | 12.2 | 0.2 | — | 16.4 | 6.4 | 1.0 | — | — | — | other |
| 87 | 12.2 | 0.2 | — | 16.5 | 6.5 | — | 1.0 | — | — | other |
| 88 | 12.1 | 0.2 | — | 16.6 | 6.5 | — | — | 1.0 | — | other |
| 89 | 12.4 | — | 0.2 | — | 5.9 | — | — | — | — | other |
| 90 | 12.5 | — | 0.2 | — | 6.0 | 1.0 | — | — | — | other |
| 91 | 12.3 | — | 0.2 | — | 6.0 | — | 0.6 | — | — | other |
| 92 | 12.4 | — | 0.2 | — | 6.1 | — | — | 0.5 | — | other |
| 93 | 12.3 | — | — | 6.0 | 6.5 | 0.5 | 0.5 | — | — | other |
| 94 | 12.2 | — | — | 5.9 | 6.5 | 0.5 | — | 0.5 | — | other |
| 95 | 12.2 | — | — | 5.9 | 6.6 | — | 0.5 | 0.5 | — | other |
| 96 | 13.2 | 0.2 | — | — | 6.0 | 0.5 | 0.5 | — | — | other |
| 97 | 13.1 | 0.2 | — | — | 6.1 | 1.0 | — | 0.5 | — | other |
| 98 | 13.2 | 0.2 | — | — | 6.0 | — | 1.0 | 0.5 | — | other |
| 99 | 12.2 | — | — | 6.5 | 6.4 | 0.2 | 0.3 | 0.5 | — | other |
| 100 | 13.1 | 0.2 | — | 6.5 | 6.0 | 0.5 | 0.3 | 0.3 | — | other |
| 101 | 12.3 | 0.4 | — | 16.7 | 7.0 | 0.5 | — | — | — | other |
| 102 | 12.2 | 0.3 | — | 16.7 | 7.0 | 0.5 | — | — | 0.5 Nb | other |
| 103 | 12.3 | 0.3 | — | 16.8 | 7.0 | 0.5 | — | 0.3 | 0.3 Ta | other |
| 104 | 12.2 | — | 0.2 | 11.8 | 6.5 | — | 0.8 | — | — | other |
| 105 | 12.3 | — | 0.2 | 11.7 | 6.5 | — | 0.8 | — | 0.3 Mo | other |
| 106 | 12.2 | — | 0.2 | 11.5 | 6.5 | — | 0.8 | — | 0.2 W | other |

TABLE 6

| R—Fe—B alloy ingots | Manufacturing conditions of R—T—B magnet alloy powder | | | Presence of magnetic field upon molding | Magnetic property of bonded magnets | | | |
|---|---|---|---|---|---|---|---|---|
| | regenerative material | Hydrogenation | Dehydrogenation | | Br (KG) | iHc (KOe) | $BH_{max}$ (MGOe) | Squareness Hk/iHc |
| Powders of the invention | | | | | | | | |
| 85 | Alumina ball | Temperature: 850° C. $H_2$ pressure: 760 Torr | Temperature: 850° C. Vacuum: $1 \times 10^{-5}$ Torr | Present | 7.0 | 11.6 | 10.8 | 0.39 |
| | | | | Absent | 6.0 | 11.8 | 8.1 | 0.33 |
| 86 | | | | Present | 6.7 | 14.5 | 9.7 | 0.30 |
| | | | | Absent | 6.3 | 14.6 | 9.0 | 0.36 |
| 87 | | | | Present | 6.4 | 13.8 | 9.0 | 0.35 |
| | | | | Absent | 6.2 | 14.0 | 8.3 | 0.31 |
| 88 | | | | Present | 6.0 | 10.0 | 8.1 | 0.45 |
| | | | | Absent | 5.9 | 10.4 | 8.0 | 0.45 |
| 89 | | | | Present | 6.5 | 10.5 | 9.0 | 0.34 |
| | | | | Absent | 5.9 | 10.6 | 7.4 | 0.31 |
| 90 | | | | Present | 6.3 | 15.5 | 9.1 | 0.38 |
| | | | | Absent | 6.1 | 15.7 | 8.2 | 0.27 |
| 91 | | | | Present | 6.3 | 11.3 | 8.5 | 0.32 |
| | | | | Absent | 6.1 | 11.4 | 7.9 | 0.28 |
| 92 | | | | Present | 5.9 | 9.8 | 7.8 | 0.39 |
| | | | | Absent | 5.8 | 10.0 | 7.6 | 0.40 |
| 93 | | | | Present | 6.3 | 12.8 | 8.8 | 0.32 |
| | | | | Absent | 6.1 | 12.8 | 8.0 | 0.26 |
| Examples of the powders | | | | | | | | |
| 94 | Alumina ball | Temperature: 850° C. $H_2$ pressure: 760 Torr | Temperature: 850° C. Vacuum: $1 \times 10^{-5}$ Torr | Present | 6.1 | 10.4 | 8.1 | 0.38 |
| | | | | Absent | 6.0 | 10.3 | 8.0 | 0.34 |
| 95 | | | | Present | 6.0 | 9.5 | 8.1 | 0.46 |
| | | | | Absent | 6.0 | 9.7 | 8.0 | 0.41 |
| 96 | | | | Present | 6.4 | 10.7 | 9.1 | 0.39 |
| | | | | Absent | 6.2 | 10.8 | 8.3 | 0.33 |
| 97 | | | | Present | 5.9 | 9.6 | 7.9 | 0.48 |
| | | | | Absent | 5.9 | 9.9 | 7.8 | 0.43 |
| 98 | | | | Present | 6.0 | 10.5 | 8.0 | 0.41 |
| | | | | Absent | 5.9 | 10.7 | 7.8 | 0.39 |
| 99 | | | | Present | 5.9 | 10.7 | 7.8 | 0.37 |
| | | | | Absent | 5.9 | 11.0 | 7.8 | 0.37 |
| 100 | | | | Present | 6.0 | 11.1 | 7.9 | 0.29 |
| | | | | Absent | 5.8 | 11.4 | 7.5 | 0.33 |
| 101 | | | | Present | 6.4 | 13.1 | 8.7 | 0.24 |
| | | | | Absent | 6.1 | 13.3 | 8.0 | 0.24 |
| 102 | | | | Present | 6.3 | 11.5 | 8.8 | 0.33 |
| | | | | Absent | 6.2 | 11.8 | 8.3 | 0.27 |
| Powders of the invention | | | | | | | | |
| 103 | Alumina ball | Temperature: 850° C. $H_2$ pressure: 760 Torr | Temperature: 850° C. Vacuum: $1 \times 10^{-5}$ Torr | Present | 6.4 | 12.2 | 9.1 | 0.29 |
| | | | | Absent | 6.2 | 12.3 | 8.4 | 0.26 |
| 104 | | | | Present | 6.2 | 12.5 | 8.3 | 0.25 |
| | | | | Absent | 6.0 | 12.6 | 7.8 | 0.21 |
| 105 | | | | Present | 6.2 | 11.9 | 8.5 | 0.33 |

TABLE 6-continued

| R—Fe—B alloy ingots | Manufacturing conditions of R—T—B magnet alloy powder | | | Presence of magnetic field upon molding | Magnetic property of bonded magnets | | | |
|---|---|---|---|---|---|---|---|---|
| | regenerative material | Hydrogenation | Dehydrogenation | | Br (KG) | iHc (KOe) | $BH_{max}$ (MGOe) | Squareness Hk/iHc |
| 106 | | | | Absent | 6.1 | 12.0 | 8.1 | 0.29 |
| | | | | Present | 6.2 | 12.3 | 8.4 | 0.28 |
| | | | | Absent | 6.2 | 12.4 | 8.4 | 0.28 |

" ※ " denotes values out of the range of the invention

TABLE 7

| R—Fe—B alloy ingots | Manufacturing conditions of R—Fe—B magnet alloy powder | | | Presence of magnetic field upon molding | Magnetic property of bonded magnets | | | |
|---|---|---|---|---|---|---|---|---|
| | Regenerative material | Hydrogenation | Dehydrogenation | | Br (KG) | iHc (KOe) | $BH_{max}$ (MGOe) | Squareness Hk/iHc |
| Comparative powders | | | | | | | | |
| 85 | —※ | Temperature: 850° C. $H_2$ pressure: 760 Torr | Temperature: 850° C. Vacuum: $1 \times 10^{-5}$ Torr | Present | 6.5 | 9.4 | 7.1 | 0.16 |
| 86 | | | | Absent | 5.7 | 9.6 | 6.5 | 0.20 |
| | | | | Present | 6.3 | 11.3 | 7.0 | 0.13 |
| 87 | | | | Absent | 6.0 | 11.5 | 6.1 | 0.12 |
| | | | | Present | 6.0 | 10.0 | 7.0 | 0.20 |
| 88 | | | | Absent | 5.7 | 10.0 | 5.8 | 0.15 |
| | | | | Present | 5.5 | 7.6 | 5.9 | 0.23 |
| 89 | | | | Absent | 5.4 | 7.9 | 5.8 | 0.24 |
| | | | | Present | 5.7 | 8.0 | 6.2 | 0.21 |
| 90 | | | | Absent | 5.5 | 8.1 | 5.7 | 0.21 |
| | | | | Present | 5.8 | 13.7 | 7.1 | 0.21 |
| 91 | | | | Absent | 5.3 | 13.8 | 6.0 | 0.18 |
| | | | | Present | 5.9 | 8.6 | 6.3 | 0.19 |
| 92 | | | | Absent | 5.4 | 8.8 | 5.2 | 0.15 |
| | | | | Present | 5.2 | 5.4 | 5.0 | 0.32 |
| 93 | | | | Absent | 5.0 | 5.4 | 4.4 | 0.22 |
| | | | | Present | 5.9 | 10.3 | 6.5 | 0.16 |
| 94 | | | | Absent | 5.7 | 10.5 | 6.1 | 0.17 |
| | | | | Present | 5.8 | 8.7 | 6.2 | 0.23 |
| 95 | | | | Absent | 5.7 | 8.6 | 5.3 | 0.14 |
| | | | | Present | 5.8 | 5.7 | 6.0 | 0.29 |
| 96 | | | | Absent | 5.6 | 5.8 | 4.9 | 0.29 |
| | | | | Present | 5.4 | 6.4 | 5.5 | 0.25 |
| 97 | | | | Absent | 5.0 | 6.7 | 4.2 | 0.18 |
| | | | | Present | 5.7 | 6.5 | 5.8 | 0.23 |
| 98 | | | | Absent | 5.5 | 6.5 | 4.5 | 0.15 |
| | | | | Present | 5.5 | 5.3 | 5.3 | 0.26 |
| 99 | | | | Absent | 5.2 | 5.5 | 4.2 | 0.20 |
| | | | | Present | 5.6 | 6.3 | 5.1 | 0.20 |
| 100 | | | | Absent | 5.1 | 6.7 | 4.0 | 0.13 |
| | | | | Present | 5.5 | 7.2 | 4.9 | 0.18 |
| 101 | | | | Absent | 5.4 | 7.3 | 4.7 | 0.23 |
| | | | | Present | 5.9 | 10.1 | 6.5 | 0.20 |
| 102 | | | | Absent | 5.8 | 10.4 | 6.2 | 0.19 |
| | | | | Present | 5.8 | 9.5 | 6.0 | 0.21 |
| 103 | | | | Absent | 5.7 | 9.6 | 5.7 | 0.19 |
| | | | | Present | 5.7 | 8.5 | 6.5 | 0.24 |
| 104 | | | | Absent | 5.6 | 8.7 | 6.2 | 0.21 |
| | | | | Present | 5.7 | 9.5 | 5.7 | 0.16 |
| 105 | | | | Absent | 5.6 | 9.6 | 5.6 | 0.15 |
| | | | | Present | 5.5 | 8.7 | 6.1 | 0.22 |
| 106 | | | | Absent | 5.5 | 8.7 | 6.0 | 0.22 |
| | | | | Present | 5.6 | 8.9 | 5.6 | 0.18 |
| | | | | Absent | 5.6 | 9.1 | 5.5 | 0.16 |

" ※ " denotes values out of the range of the invention

TABLE 8

| | Manufacturing conditions of R—Fe—B magnet alloy powder | | | | | Magnetic property of bonded magnets | | | |
|---|---|---|---|---|---|---|---|---|---|
| | | Hydrogenation | | Dehydrogenation | | | | | |
| | Regenerative material | Temperature (°C.) | $H_2$ pressure (Torr) | Temperature (°C.) | Vacuum (Torr) | Br (KG) | iHc (KOe) | $BH_{max}$ (MGOe) | Hk/iHc |
| Powders of the invention | | | | | | | | | |
| 107 | Stainless steel plate | 750 | 1 | 750 | $5 \times 10^{-4}$ | 6.0 | 9.8 | 7.2 | 0.24 |
| 108 | | 800 | 1 | 800 | $5 \times 10^{-5}$ | 6.3 | 14.5 | 8.6 | 0.28 |
| 109 | | 830 | 1 | 830 | $5 \times 10^{-5}$ | 6.3 | 14.2 | 8.6 | 0.27 |
| 110 | | 870 | 1 | 870 | $1 \times 10^{-5}$ | 6.2 | 13.6 | 8.2 | 0.25 |
| 111 | | 900 | 1 | 900 | $2 \times 10^{-5}$ | 6.1 | 11.3 | 8.0 | 0.28 |
| 112 | | 950 | 1 | 950 | $1 \times 10^{-5}$ | 6.1 | 10.6 | 8.0 | 0.29 |
| Comparative | | | | | | | | | |

TABLE 8-continued

| | Manufacturing conditions of R—Fe—B magnet alloy powder | | | | | Magnetic property of bonded magnets | | | |
|---|---|---|---|---|---|---|---|---|---|
| | Regenerative material | Hydrogenation Temperature (°C.) | Hydrogenation $H_2$ pressure (Torr) | Dehydrogenation Temperature (°C.) | Dehydrogenation Vacuum (Torr) | Br (KG) | iHc (KOe) | $BH_{max}$ (MGOe) | Hk/iHc |
| powders | | | | | | | | | |
| 107 | | 700※ | 1 | 700※ | $5 \times 10^{-4}$ | 5.7 | 4.3 | 5.1 | 0.30 |
| 108 | | 1000※ | 1 | 1000※ | $1 \times 10^{-5}$ | 3.8 | 1.2 | <1 | — |

"※" denotes values out of the range of the invention

TABLE 9

| R—Fe—B alloy ingots | Alloy composition (Atomic %) Nd | B | Ga | Zr | Hf | Co | Fe & impurities |
|---|---|---|---|---|---|---|---|
| 113 | 12.5 | 6.2 | — | — | — | 15.3 | other |
| 114 | 12.5 | 6.1 | 0.5 | — | — | 11.2 | other |
| 115 | 12.5 | 6.0 | — | 0.2 | — | 12.0 | other |
| 116 | 12.5 | 6.0 | — | — | 0.2 | 11.5 | other |
| 117 | 12.4 | 6.2 | — | — | — | — | other |
| 118 | 12.4 | 6.0 | 0.6 | — | — | — | other |
| 119 | 12.4 | 5.9 | — | 0.1 | — | — | other |
| 120 | 12.5 | 6.0 | — | — | 0.1 | — | other |

TABLE 9-continued

| R—Fe—B alloy ingots | Alloy composition (Atomic %) Nd | B | Ga | Zr | Hf | Co | Fe & impurities |
|---|---|---|---|---|---|---|---|
| 121 | 12.0 | 5.9 | 1.0 | 0.2 | — | 14.0 | other |
| 122 | 12.0 | 5.9 | 1.0 | — | 0.2 | 14.0 | other |
| 123 | 12.1 | 5.9 | 1.0 | 0.2 | 0.2 | 14.0 | other |
| 124 | 12.9 | 5.9 | 0.6 | 0.1 | — | — | other |
| 125 | 13.1 | 5.9 | 0.6 | — | 0.1 | — | other |
| 126 | 13.1 | 6.0 | 0.6 | 0.1 | 0.1 | — | other |
| 127 | 12.4 | 6.0 | — | 0.1 | 0.2 | 15.7 | other |
| 128 | 12.3 | 6.1 | — | 0.1 | 0.2 | — | other |

TABLE 10

| R—Fe—B alloy ingots | Manufacturing conditions of R—Fe—B magnet alloy powder: Use of regenerative material | Hydrogenation Temperature (°C.) | Hydrogenation $H_2$ pressure (Torr) | Dehydrogenation Temperature (°C.) | Dehydrogenation Vacuum (Torr) | Presence of magnetic field upon molding | Magnetic property of bonded magnets: Br (KG) | iHc (KOe) | $BH_{max}$ (MGOe) |
|---|---|---|---|---|---|---|---|---|---|
| Powders of the invention | | | | | | | | | |
| 113 | Used | 850 | 760 | 850 | $1 \times 10^{-5}$ | Present | 6.8 | 11.6 | 9.8 |
| | | | | | | Absent | 6.1 | 11.8 | 8.1 |
| 114 | | | | | | Present | 8.5 | 14.2 | 16.7 |
| | | | | | | Absent | 5.8 | 14.4 | 7.5 |
| 115 | | | | | | Present | 7.8 | 10.3 | 12.1 |
| | | | | | | Absent | 5.7 | 10.3 | 7.1 |
| 116 | | | | | | Present | 8.1 | 9.8 | 15.0 |
| | | | | | | Absent | 5.7 | 10.0 | 7.2 |
| 117 | | | | | | Present | 6.7 | 11.0 | 9.7 |
| | | | | | | Absent | 5.9 | 11.3 | 7.7 |
| 118 | | | | | | Present | 8.1 | 14.3 | 15.1 |
| | | | | | | Absent | 5.7 | 14.5 | 7.2 |
| 119 | | | | | | Present | 7.5 | 10.5 | 12.6 |
| | | | | | | Absent | 5.6 | 10.5 | 7.3 |
| 120 | | | | | | Present | 7.8 | 10.0 | 13.8 |
| | | | | | | Absent | 5.6 | 10.2 | 7.3 |
| 121 | | | | | | Present | 7.8 | 12.1 | 14.1 |
| | | | | | | Absent | 6.1 | 12.5 | 8.1 |
| 122 | | | | | | Present | 8.3 | 10.4 | 16.0 |
| | | | | | | Absent | 6.0 | 10.8 | 7.9 |
| 123 | | | | | | Present | 7.8 | 10.4 | 13.5 |
| | | | | | | Absent | 5.9 | 10.6 | 7.5 |
| 124 | | | | | | Present | 7.8 | 14.8 | 13.2 |
| | | | | | | Absent | 5.9 | 15.3 | 7.9 |
| 125 | | | | | | Present | 8.0 | 12.6 | 13.5 |
| | | | | | | Absent | 5.7 | 12.9 | 7.6 |
| 126 | | | | | | Present | 7.8 | 12.4 | 13.0 |
| | | | | | | Absent | 5.7 | 12.7 | 7.5 |
| 127 | | | | | | Present | 8.2 | 9.6 | 12.6 |
| | | | | | | Absent | 5.6 | 9.9 | 7.0 |
| 128 | | | | | | Present | 7.8 | 8.7 | 12.0 |
| | | | | | | Absent | 5.5 | 9.2 | 6.4 |

TABLE 11

| R—Fe—B alloy ingots | Manufacturing conditions of R—Fe—B magnet alloy powder: Use of regenerative material | Hydrogenation Temperature (°C.) | Hydrogenation $H_2$ pressure (Torr) | Dehydrogenation Temperature (°C.) | Dehydrogenation Vacuum (Torr) | Presence of magnetic field upon molding | Magnetic property of bonded magnets: Br (KG) | iHc (KOe) | $BH_{max}$ (MGOe) |
|---|---|---|---|---|---|---|---|---|---|
| Comparative powders | | | | | | | | | |
| 113 | Not Used | 850 | 760 | 850 | $1 \times 10^{-5}$ | Present | 6.3 | 9.4 | 8.1 |
| | | | | | | Absent | 5.9 | 9.5 | 7.0 |
| 114 | | | | | | Present | 7.6 | 11.5 | 11.5 |

TABLE 11-continued

| R—Fe—B alloy ingots | Manufacturing conditions of R—Fe—B magnet alloy powder: Use of regenerative material | Hydrogenation: Temperature (°C.) | Hydrogenation: $H_2$ pressure (Torr) | Dehydrogenation: Temperature (°C.) | Dehydrogenation: Vacuum (Torr) | Presence of magnetic field upon molding | Magnetic property of bonded magnets: Br (KG) | iHc (KOe) | $BH_{max}$ (MGOe) |
|---|---|---|---|---|---|---|---|---|---|
| 115 | | | | | | Absent | 5.6 | 11.4 | 6.3 |
| | | | | | | Present | 7.2 | 8.4 | 10.5 |
| 116 | | | | | | Absent | 5.5 | 8.5 | 6.2 |
| | | | | | | Present | 7.4 | 7.6 | 11.2 |
| 117 | | | | | | Absent | 5.5 | 7.8 | 6.1 |
| | | | | | | Present | 6.1 | 9.4 | 8.0 |
| 118 | | | | | | Absent | 5.6 | 9.5 | 6.6 |
| | | | | | | Present | 7.5 | 10.8 | 11.0 |
| 119 | | | | | | Absent | 5.5 | 11.0 | 6.4 |
| | | | | | | Present | 7.0 | 9.0 | 10.0 |
| 120 | | | | | | Absent | 5.4 | 9.1 | 5.8 |
| | | | | | | Present | 7.2 | 7.8 | 10.1 |
| 121 | | | | | | Absent | 5.4 | 8.2 | 5.5 |
| | | | | | | Present | 7.3 | 10.7 | 11.2 |
| 122 | | | | | | Absent | 5.8 | 10.9 | 6.4 |
| | | | | | | Present | 7.2 | 9.0 | 10.4 |
| 123 | | | | | | Absent | 5.8 | 9.2 | 6.1 |
| | | | | | | Present | 7.0 | 9.5 | 10.5 |
| 124 | | | | | | Absent | 5.8 | 9.4 | 6.1 |
| | | | | | | Present | 6.5 | 12.1 | 9.2 |
| 125 | | | | | | Absent | 5.9 | 12.4 | 7.0 |
| | | | | | | Present | 6.9 | 9.3 | 10.4 |
| 126 | | | | | | Absent | 5.9 | 9.5 | 6.7 |
| | | | | | | Present | 6.8 | 10.0 | 9.9 |
| 127 | | | | | | Absent | 5.8 | 10.4 | 7.1 |
| | | | | | | Present | 7.0 | 7.6 | 9.8 |
| 128 | | | | | | Absent | 5.2 | 7.8 | 5.0 |
| | | | | | | Present | 7.2 | 5.4 | 8.0 |
| | | | | | | Absent | 5.0 | 6.0 | 4.8 |

TABLE 12

| | Manufacturing conditions of R—Fe—B magnet alloy powder: Regenerative material | Hydrogenation: Temperature (°C.) | Hydrogenation: $H_2$ pressure (Torr) | Dehydrogenation: Temperature (°C.) | Dehydrogenation: Vacuum (Torr) | Molding conditions in the presence of magnetic field | Magnetic property of bonded magnets: Br (KG) | iHc (KOe) | $BH_{max}$ (MGOe) |
|---|---|---|---|---|---|---|---|---|---|
| Powders of the invention | | | | | | | | | |
| 129 | Magnesia plate | 750 | 1 | 750 | $2 \times 10^{-4}$ | Magnetic field: 20 KOe Pressure: 6 Ton/cm² | 7.8 | 11.8 | 12.6 |
| 130 | | 800 | 1 | 800 | $5 \times 10^{-5}$ | | 8.5 | 13.6 | 16.2 |
| 131 | | 830 | 1 | 830 | $3 \times 10^{-5}$ | | 8.7 | 12.4 | 18.0 |
| 132 | | 870 | 1 | 870 | $1 \times 10^{-5}$ | | 8.6 | 13.6 | 17.1 |
| 133 | | 900 | 1 | 900 | $2 \times 10^{-5}$ | | 8.0 | 12.4 | 14.2 |
| 134 | | 950 | 1 | 950 | $1 \times 10^{-5}$ | | 7.8 | 11.0 | 13.3 |
| Comparative powders | | | | | | | | | |
| 129 | | 700※ | 1 | 700※ | $4 \times 10^{-4}$ | | 6.2 | 10.3 | 8.4 |
| 130 | | 1000※ | 1 | 1000※ | $5 \times 10^{-6}$ | | 7.4 | 4.1 | 6.3 |

" ※ " denotes values out of the range of the invention

What is claimed is:

1. A rare earth permanent magnet powder which exhibits superior magnetic anisotropy and high resistance to corrosion comprising particles each containing:
   a) 10 to 20 atomic percent of R;
   b) 3 to 20 atomic percent of B;
   c) 0.001 to 5.0 atomic percent of at least one element selected from the group consisting of Ga, Zr and Hf;
   d) and the balance Fe and unavoidable impurities, wherein R represents a rare earth element, said individual particle comprises an aggregated structure of recrystallized grains which consist essentially of an $R_2Fe_{14}B$ intermetallic compound phase of a tetragonal crystal structure as a principal phase and have an average alloy crystal grain size of 0.05 to 20 μm, wherein at least 50% by volume of said recrystallized grains are formed so that a ratio of the greatest dimension to the smallest dimension is less than 2 for each recrystallized grain.

2. A rare earth permanent magnet powder which exhibits superior magnetic anisotropy and high resistance to corrsion comprising particles each containing:
   a) 10 to 20 atomic percent of R;
   b) 0.1 to 50 atomic percent of Co;
   c) 3 to 20 atomic percent of B;
   d) 0.001 to 5.0 atomic percent of at least one element selected from the group consisting of Ga, Zr and Hf;
   e) and the balance Fe and unavoidable impurities, wherein R represents a rare earth element, said individual particle comprises an aggregated structure of recrystallized grains which consist essentially of an $R_2(Fe,Co)_{14}B$ intermetallic phase of a tetragonal crystal structure as a principal phase and have an average alloy crystal grain size of 0.05 to 20 μm, wherein at least 50% by volume of said recrystallized grains are formed so that a ratio of the greatest dimension to the smallest dimension is less than 2 for each recrystallized grain.

3. A rare earth permanent magnet powder according to claim 1 or claim 2, wherein a part of Fe is substituted by 0.01 to 2.0 atomic percent of at least one element selected from the group consisting of Al, V and Si.

4. A rare earth permanent magnet powder according to claim 1 or claim 2, wherein the average crystal grain size of the recrystallized grains ranges from 0.05 to 3 μm.

5. A rare earth permanent magnet powder according to claim 3, wherein the average crystal grain size of the recrystallized grains ranges from 0.05 to 3 μm.

6. A rare earth permanent magnet powder according to claim 4, in which said aggregated structure essentially consists of the recrystallized grains of said intermetallic compound phases.

7. A rare earth permanent magnet powder according to claim 5, in which said aggregated structure essentially consists of the recrystallized grains of said intermetallic compound phases.

8. A bonded magnet produced by the steps of:

a) preparing an R-Fe-B permanent magnet powder which comprises particles each containing 10 to 20 atomic percent of R, 3 to 20 atomic percent of B, 0.001 to 5.0 atomic percent of at least one element selected from the group consisting of Ga, Zr and Hf, and the balance Fe and unavoidable impurities, wherein R represents a rare each element, said individual particle comprises an aggregated structure of recrystallized grains which consist essentially of an $R_2Fe_{14}B$ intermetallic compound phase of a tetragonal crystal structure as a principal phase and have an average alloy crystal grain size of 0.05 to 20 μm, wherein at least 50% by volume of said recrystallized grains are formed so that a ratio of the greatest dimension to the smallest dimension is less than 2 for each recrystallized grain;

b) blending said magnetic powder with a resin; and c) pressing the blended powder of step b to provide the bonded magnet.

9. A bonded magnet produced by the steps of:

a) preparing a R-Fe-Co-B permanent magnet powder which comprises particles each containing 10 to 20 atomic percent of R, 0.1 to 50 atomic percent of Co, 3 to 20 atomic percent of B, 0.001 to 5.0 atomic percent of at least one element selected from the group consisting of Ga, Zr and Hf, and the balance Fe and unavoidable impurities, wherein R represents a rare earth element, said individual particle comprises an aggregated structure of recrystallized grains which consist essentially of an $R_2(Fe,Co)_{14}B$ intermetallic compound phase of a tetragonal crystal structure as a principal phase and have an average alloy crystal grain size of 0.05 to 20 μm, wherein at least 50% by volume of said recrystallized grains are formed so that a ratio of the greatest dimension to the smallest dimension is less than 2 for each recrystallized grain;

b) blending said magnet powder with a resin; and c) pressing the blended powder of step b to provide the bonded magnet.

10. A rare earth permanent magnet powder according to claim 8 or claim 9, wherein a part of Fe is substituted by 0.01 to 2.0 atomic percent of at least one element selected from the group consisting of Al, V and Si.

11. A rare earth permanent magnet powder according to claim 8 or claim 9, wherein the average crystal grain size of the recrystallized grains ranges from 0.05 to 3 μm.

12. A rare earth permanent magnet powder according to claim 10, wherein the average crystal grain size of the recrystallized grains ranges from 0.05 to 3 μm.

13. A rare earth permanent magnet powder according to claim 11, in which said aggregated structure essentially consists of the recrystallized grains of said intermetallic compound phases.

14. A rare earth permanent magnet powder according to claim 12, in which said aggregated structure essentially consists of the recrystallized grains of said intermetallic compound phases.

* * * * *

UNITED STATES PATENT AND TRADEMARK OFFICE

CERTIFICATE OF CORRECTION

PATENT NO. : 5,228,930

DATED : July 20, 1993

INVENTOR(S) : Nakayama, et al.

It is certified that error appears in the above-indentified patent and that said Letters Patent is hereby corrected as shown below:

On the Title Page, Section [54]: "POWER" should read as --POWDER--

Column 1, line 2: "POWER" should read --POWDER--

Column 10, line 65: "intermattalic" should read --intermettalic--

Column 14, line 61: "Table 1" should read --Table 12--

Signed and Sealed this

Ninth Day of May, 1995

Bruce Lehman

*Attest:*

BRUCE LEHMAN

*Attesting Officer*

*Commissioner of Patents and Trademarks*